US011167181B1

(12) United States Patent
Pallotta et al.

(10) Patent No.: US 11,167,181 B1
(45) Date of Patent: Nov. 9, 2021

(54) GOLF CLUB HEAD AND SHAFT CONNECTOR

(71) Applicant: Integran Technologies Inc., Mississauga (CA)

(72) Inventors: Robert David Pallotta, Etobicoke (CA); David Lionel Limoges, Etobicoke (CA); Daniel Plaggenborg, Mississauga (CA)

(73) Assignee: Integran Technologies Inc., Mississauga (CA)

( * ) Notice: Subject to any disclaimer, the term of this patent is extended or adjusted under 35 U.S.C. 154(b) by 0 days.

(21) Appl. No.: 16/998,700

(22) Filed: Aug. 20, 2020

(51) Int. Cl.
*A63B 53/02* (2015.01)

(52) U.S. Cl.
CPC ..... *A63B 53/02* (2013.01)

(58) Field of Classification Search
CPC ..... A63B 53/02
See application file for complete search history.

(56) References Cited

U.S. PATENT DOCUMENTS

| | | | | | |
|---|---|---|---|---|---|
| 244,510 | A * | 7/1881 | Abernathy | F16B 39/12 | 411/245 |
| 2,464,850 | A * | 3/1949 | Crawshaw | A63B 53/00 | 473/299 |
| 3,170,691 | A * | 2/1965 | Pritchard | A63B 60/00 | 473/306 |
| 3,759,517 | A * | 9/1973 | Mills | A63B 60/00 | 473/306 |
| 3,854,350 | A | 12/1974 | Bauer et al. | | |
| 5,885,170 | A * | 3/1999 | Takeda | A63B 53/04 | 473/306 |
| 6,371,865 | B1 * | 4/2002 | Magliulo | A63B 60/22 | 473/256 |
| 7,207,897 | B2 * | 4/2007 | Burch | A63B 53/02 | 473/288 |
| 7,601,075 | B2 * | 10/2009 | Cole | A63B 60/00 | 473/288 |
| 7,857,709 | B2 | 12/2010 | Burch | | |
| 8,046,899 | B2 | 11/2011 | Burch | | |
| 8,562,454 | B2 | 10/2013 | Burch | | |
| 10,125,808 | B2 * | 11/2018 | Michiwaki | F16B 39/38 | |
| 2005/0143186 | A1 * | 6/2005 | Blattner | A63B 53/14 | 473/296 |
| 2005/0176521 | A1 | 8/2005 | Burch et al. | | |
| 2007/0173344 | A1 * | 7/2007 | Burch | A63B 53/02 | 473/305 |

(Continued)

*Primary Examiner* — Stephen L Blau
(74) *Attorney, Agent, or Firm* — Rankin, Hill & Clark LLP

(57) ABSTRACT

A connector forms a releasable connection of a golf club shaft and a golf club head. The connector includes a shaft-mount and a head-mount. The shaft-mount has a first threaded coupling member and a bore that is sized to securely receive the golf club shaft. The head-mount has a second threaded coupling member. The head-mount is sized to be securely received within the bore of the hosel of the golf club head. The first threaded coupling member of the shaft-mount mates with the second threaded coupling member of the head-mount to form a releasable connection of the golf club shaft and the golf club head. The first threaded coupling member of the shaft-mount has dual-handed-thread ability which allows the releasable connection to follow left-handed-thread convention and right-hand-thread convention.

16 Claims, 20 Drawing Sheets

(56) References Cited

U.S. PATENT DOCUMENTS

| | | | | |
|---|---|---|---|---|
| 2010/0035700 | A1 | 2/2010 | Yu et al. | |
| 2011/0059809 | A1* | 3/2011 | Guest | A63B 60/00 473/288 |
| 2011/0086724 | A1 | 4/2011 | Burch | |
| 2012/0225729 | A1 | 9/2012 | Burch | |
| 2015/0273285 | A1 | 10/2015 | Burch | |
| 2017/0296882 | A1 | 10/2017 | Burch | |
| 2018/0023615 | A1* | 1/2018 | Michiwaki | F16B 37/00 411/242 |

* cited by examiner

GOLF CLUB HEAD AND SHAFT CONNECTOR

BACKGROUND

The present disclosure generally relates to golf clubs, and more particularly to connectors used between a golf club shaft and a golf club head.

The typical method to connect a golf club shaft and a golf club head is to use an adhesive to secure a tip end of the golf club shaft into a bore formed within a hosel portion of the golf club head. The sizing of the tip end of the shaft as well as the bore of the hosel is generally standardized in the golf industry. As a result, these components are interchangeable, i.e. different shafts from different shaft manufacturers may be combined with different club heads from different club head manufacturers. This interchangeability allows a golf club to be comprised of various combinations of shafts and club heads from different manufacturers.

To test the performance, feel, and appearance of different shaft and club head combinations, golfers often go to golf-equipment-stores that offer a selection of different shafts and different club heads. The typical adhesive connection between the shaft and club head is not a releasable connection and it generally takes over ten minutes for the adhesive to set. As such, to facilitate the ease and speed in which various combinations of shafts and club heads may be tested by a golfer, golf-equipment-stores use releasable connectors for testing purposes. For testing purposes, golf-equipment-stores typically designate some shafts as test-shafts and some club heads as test-club-heads. Releasable connectors are used to secure test-shafts to test-club-heads. These releasable connectors enable golfers to quickly test many combinations of shafts and club heads without the golf-equipment-store needing to stock every possible combination of shaft and club head or needing to use an adhesive to connect each combination of shaft and club head for testing.

Although a releasable connector is normally used on test-shafts and test-club-heads, the golf-equipment-store typically uses an adhesive to connect the shaft and club head on the golf club that is sold to a golfer. As such, there are benefits in having a releasable connector that performs, feels, and appears similar to how the golf club would if the shaft and club head were connected using an adhesive. Thus, the design, the weight, and the appearance of a releasable connector are important.

To facilitate the ease in which various combinations of shafts and club heads may be evaluated by the golfer, some companies have devised releasable connectors that quickly secure a shaft and a club head together. Unfortunately, the known connectors have significant deficiencies. For example, some connectors require the hosel of the club head to be bored to a larger inner diameter or to be threaded to accept the connector. This process of boring the hosel or threading the hosel is not something that many golf-equipment-stores have the tools to perform and would otherwise not perform such processes to a hosel. Boring the hosel to a larger inner diameter also prevents the test-club-head from being able to be sold by the golf-equipment-store as a used product.

Other known connectors attach to the outer surface of the club head hosel. This creates a bulky appearance. This is also the case with connectors that are thicker, at any point, than the diameter of the hosel. The appearance of the golf club is a factor considered by golfers when they test a golf club. Thus it is a deficiency when a connector appears significantly different on test-shafts and test-club-heads than when shafts and club heads are secured by an adhesive.

Other known connectors are not compatible with golf club heads that feature adjustable adapters at the hosel. This includes most connectors that require the hosel to be bored to a larger inner diameter because the walls of an adjustable adapter are thinner than the walls of a non-adjustable hosel. This also includes most connectors that attach to the outer surface of the hosel because the adjustability of the adapter typically requires access to the outer surface of the adapter. A connector that is not compatible with adjustable adapters is a deficiency of the connector because there are performance, feel, appearance and adjustability advantages to being able to use the adjustable adapter from a golf club head manufacturer. Adjustable adapters typically allow for adjustments that include lie, loft, and face angle adjustments of the golf club.

Other known connectors that feature threaded coupling members that mate to form a releasable connection only have singularly-handed-threads, i.e. left-handed-threads or right-handed-threads, and thus cannot follow left-handed-thread convention and right-handed-thread convention on the same connector. As such, these connectors are not equally functional for both left-handed and right-handed club heads. This is because during impact with a golf ball or impact with the ground or throughout a golf swing, a golf club experiences torque between the club head and the shaft. This torque is resisted by the method of connection between the club head and the shaft so that ideally there is no relative rotation that is apparent between the shaft and club head. The direction of the torque is opposite between left and right-handed golfers, i.e. if a right-handed club head experiences clockwise torque about the hosel relative to the shaft, then a left-handed club head experiences counter-clockwise torque about the hosel relative to the shaft. As such, if a connector with threaded coupling members that mate to form a releasable connection tends to tighten from the toque in a right-handed golf club then that same connector will tend to loosen from the torque in a left-handed golf club. When the connection tends to tighten from the torque, no relative rotation is apparent between the shaft and club head. However, when the connection tends to loosen from the torque, the club head can rotate relative to the shaft. This prevents a golfer from using the golf club. As such, when using these known connectors, a test-shaft with a shaft-mount will not function equally for both left-handed and right-handed club heads. This is a major disadvantage of a connector because a golf-equipment-store would need to stock different test-shafts for left-handed and right-handed golfers.

Other known connectors require a wrench or other external tool to be used to tighten a lock nut, compression nut, or similar functioning threaded coupling members. The use of such external tool is tedious. Also, ambiguity can exist regarding the amount of torque in which the threaded coupling members should be tightened. This ambiguity can lead to over-tightening which can damage the threaded coupling members or under-tightening which can lead to inadequate securing of the shaft to the club head. As such, a connector that eliminates ambiguity in the amount of torque used to tighten the threaded coupling members is advantageous. This can be achieved by different means, including the abutment of the shaft-mount against the head-mount or club head hosel as a means to prevent further tightening and relative rotation between threaded coupling members.

Other known connectors use an anti-rotational member to enable a test-shaft with a shaft-mount to be used on both left-handed and right-handed club heads. The use on anti-rotational members is typically coupled by the use of a lock nut, compression nut or similar functioning threaded coupling member to prevent axial movement between the shaft-mount and head-mount. These connectors share the same disadvantages mentioned above for connectors with a lock nut, compression nut, or similar functioning threaded coupling members.

Therefore, there is a need in the art for a connector for a golf club that overcomes the noted problems in the art. The present disclosure provides such a connector. These and other advantages of the invention, as well as additional inventive features, will be apparent from the description of the present disclosure provided herein.

SUMMARY

According to one aspect of the present disclosure, a golf club connector for forming a releasable connection of an associated golf club shaft and one of an associated right-handed golf club head and an associated left-handed golf club is provided. The connector comprising a shaft-mount and a head-mount. The shaft-mount is adapted to secure an end portion of the associated golf shaft. The shaft-mount includes a first threaded coupling member having left-handed threads and right-handed threads. The head-mount is adapted to secure a hosel of the one associated golf club head. The head-mount includes a second threaded coupling member sized to threadingly mate with the first threaded coupling member to form a releasable connection of the head-mount and shaft-mount.

According to another aspect of the present disclosure, a golf club connector for forming a releasable connection of an associated golf club shaft and one of an associated right-handed golf club head and an associated left-handed golf club is provided. The connector comprises a shaft-mount adapted to secure an end portion of the associated golf shaft and one of a right-handed head-mount adapted to secure a hosel of the associated right-handed golf club head and a left-handed head-mount adapted to secure a hosel of the associated left-handed golf club head. The shaft-mount includes a first threaded coupling member having left-handed threads and right-handed threads. The right-handed head-mount includes a second threaded coupling member having mating left-handed threads for threaded engagement with the first threaded coupling member to form a releasable connection of the right-handed head-mount and shaft-mount. The left-handed head-mount includes a second threaded coupling member having mating right-handed threads for threaded engagement with the first threaded coupling member to form a releasable connection of the left-handed head-mount and shaft-mount.

According to another aspect, a golf club connector for forming a releasable connection of an associated golf club shaft and one of an associated right-handed golf club head and an associated left-handed golf club head is provided. The connector comprises a shaft-mount adapted to secure an end portion of the associated golf club shaft. The shaft-mount includes a first threaded coupling member having left-handed threads and right-handed threads. A second threaded coupling member is located on the one associated golf club head sized to threadingly mate with the first threaded coupling member to form a releasable connection of the golf club head and shaft-mount.

Therefore, according to the present disclosure, a connector is used to form a releasable connection of a golf club shaft and a golf club head. The connector includes a shaft-mount and a head-mount. The shaft-mount has a first threaded coupling member. The shaft-mount has a bore that is sized to receive the golf club shaft. The golf club shaft is secured within the bore of the shaft-mount with an adhesive. The head-mount has a second threaded coupling member. The head-mount is sized to be received within the bore of the hosel of the golf club head. The head-mount is secured within the bore of the hosel of the golf club head with an adhesive. The releasable connection is formed by mating the threaded coupling members on each of the shaft-mount and head-mount. The first and second threaded coupling members are able to follow both left-handed thread convention and right-handed thread convention, herein referred to as dual-handed threads.

In certain embodiments, dual-handed threads are achieved with intersecting left-handed threads and right-handed threads on the shaft-mount and optionally on the head-mount. Intersecting left-handed threads and right-handed threads are also referred to as overlapping left-handed threads and right-handed threads.

In certain embodiments, dual-handed threads are achieved with staggered left-handed threads and right-handed threads on the shaft-mount and optionally on the head-mount.

In certain embodiments, dual-handed threads are achieved with concentric left-handed threads and right-handed threads on an outer surface and inner surface of the shaft-mount and optionally on the head-mount.

The first and second threaded coupling members are capable of preventing rotational movement and axial movement between the shaft-mount and head-mount by the abutment of the shaft-mount against the head-mount or against the club head hosel. This abutment prevents rotational movement and axial movement between the shaft-mount and head-mount.

The dual-handed-threads allow for the mating of the first and second threaded coupling members to be equally functional for right-handed and left-handed club heads. As such, opposite thread conventions should be followed by right-handed and left-handed club heads so that the maximum torque on the golf club tends to tighten the threaded coupling members and there is no relative rotation that is apparent between the shaft and club head.

The equal functionality of the connector for right-handed and left-handed club heads allows a golf-equipment-store to use the same test-shafts and shaft-mounts for both right-handed and left-handed club heads. This is a major advantage over known connectors that require the use of an anti-rotational member and the use of lock nuts, compression nuts or similar functioning threaded coupling members to achieve equal functionality, using the same test-shaft and shaft-mount, for both left-handed and right-handed club heads.

The connector of the present disclosure allows golf-equipment-stores, golf-club-fitters, golf-club-builders, and golfers to quickly and easily connect various combinations of shafts and club heads. As such, many combinations of shafts and club heads can be tested by a golfer for performance, feel, and appearance without the need to use an adhesive to secure each combination of shaft and club head together. Such a method of releasable connection allows for the appearance and design of the connector to resemble that of a ferrule, which is traditionally placed around the shaft and on top of the hosel when a shaft is secured into a club head hosel with an adhesive.

The connector of the present disclosure can be configured so that it can be used on any type of golf club including drivers, woods, hybrids, irons, wedges, and putters. While maintaining dual-handed-threads, the shaft-mount and head-mount can be adapted to be compatible with various golf club head designs and shaft designs. For example, the bore diameter of the shaft-mount can be sized to fit different size tip ends for different shafts. The head-mount can be sized to be received within different size hosel bores for different club heads. The head-mount can be received within adjustable adapters. The head-mount can be adapted to fit onto a club head with a hosel-stem, which is commonly used in the golf industry on putter heads. The head-mount can be adapted to fit onto a club head without a hosel, which is commonly used in the golf industry on putter heads. The shaft-mount can be adapted to be received within the bore of the golf shaft and secured with an adhesive. The head-mount can be adapted to attach to the outer surface of the club head hosel.

The shaft-mount and/or head-mount can be fabricated from various materials or combinations of materials including aluminum, titanium, steel, and carbon fiber composites.

DETAILED DESCRIPTION

Figure 1:
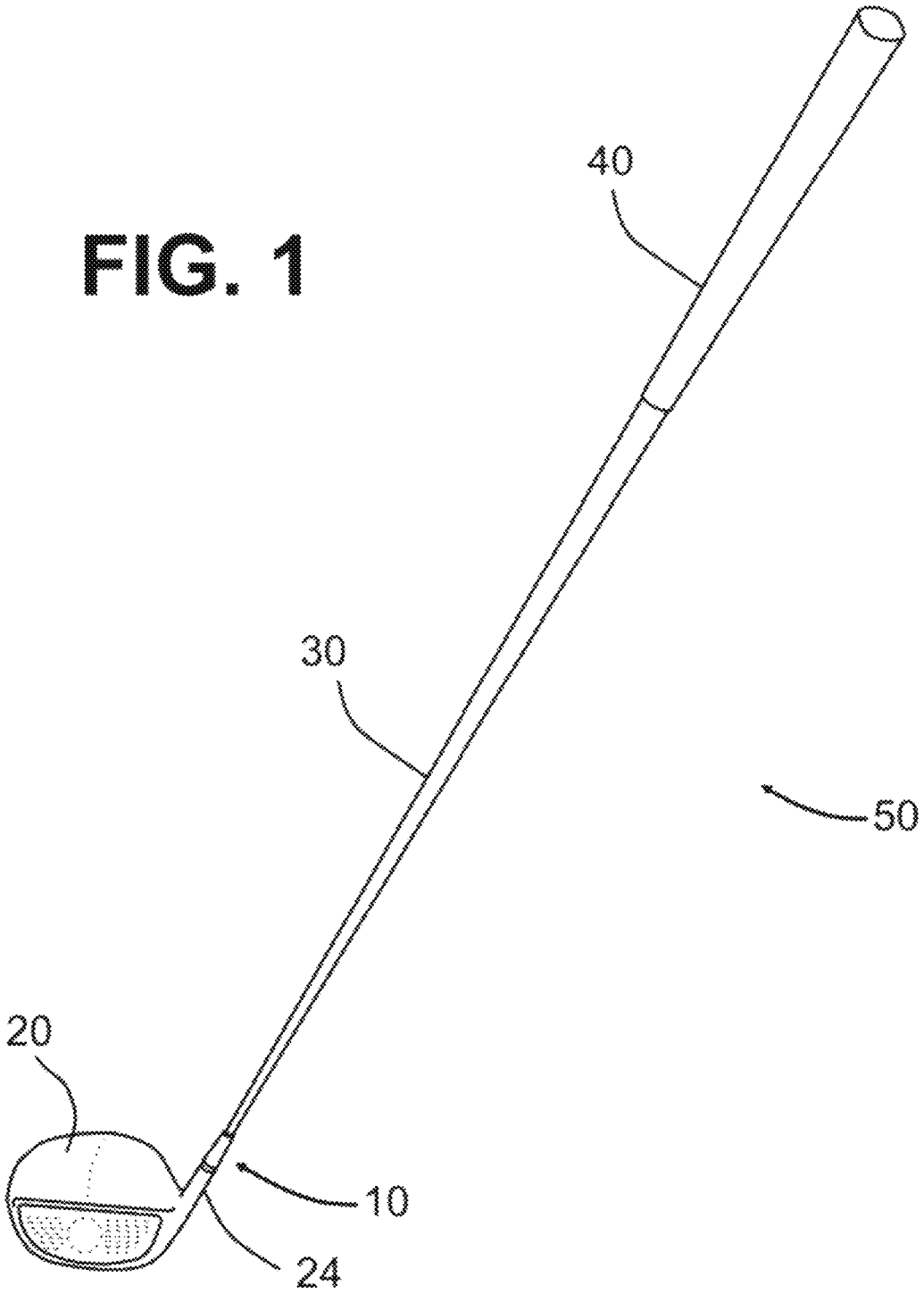
FIG. 1 is a perspective view of a right-handed golf club employing an exemplary embodiment of a connector according to the teachings of the present invention.

Referring now to the drawings, wherein like numerals refer to like parts throughout the several views, FIG. 1 depicts an embodiment of the present invention as a connector 10 that is used to form a releasable connection of a right-handed club head 20 to a golf club shaft 30. In FIG. 1, a right-handed golf club 50 is typically comprised of a right-handed club head 20, a shaft 30 secured into the right-handed club head hosel 24, and a grip 40 secured onto the shaft 30. The right-handed club head hosel 24 can be a fixed hosel or an adjustable hosel. The right-handed club head 20 can be any type of right-handed club head including a driver club head, a woods club head, a hybrid club head, an irons club head, a wedge club head, or a putter club head.

Figure 2:
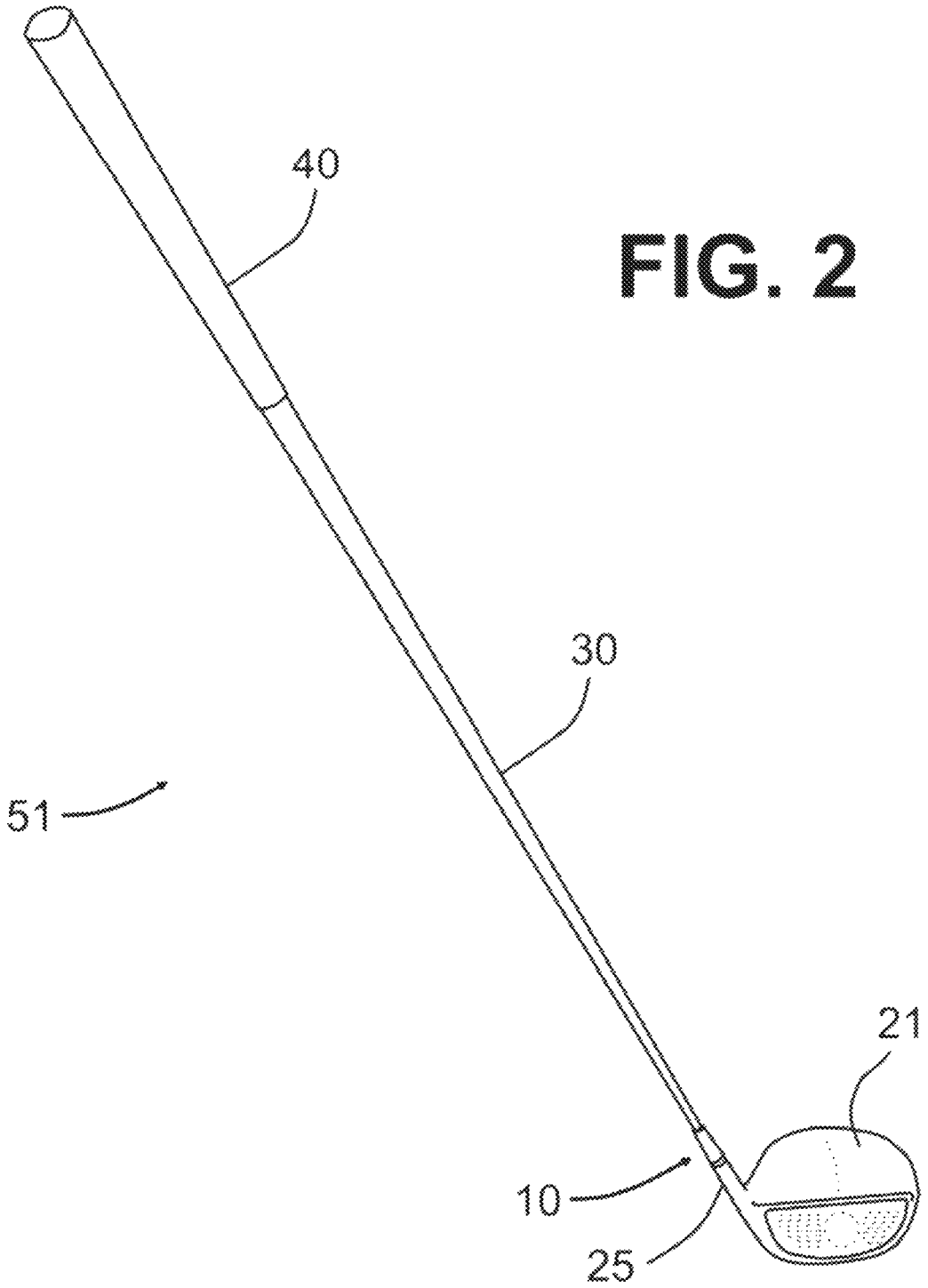
FIG. 2 is a perspective view of a left-handed golf club employing an exemplary embodiment of a connector according to the teachings of the present invention.

Referring to FIG. 2, an embodiment of the present invention is shown as the same connector 10 that is used to form a releasable connection of a left-handed club head 21 to a golf club shaft 30. In FIG. 2, a left-handed golf club 51 is typically comprised of a left-handed club head 21, a shaft (similar to and depicted as the shaft 30) secured into the left-handed club head hosel 25, and a grip secured onto the shaft (similar to and depicted as the grip 40 secured onto the shaft 30). The left-handed club head hosel 25 can be a fixed hosel or an adjustable hosel. The left-handed club head 21 can be any type of left-handed club head including a driver club head, a woods club head, a hybrid club head, an irons club head, a wedge club head, or a putter club head.

Figure 3A:
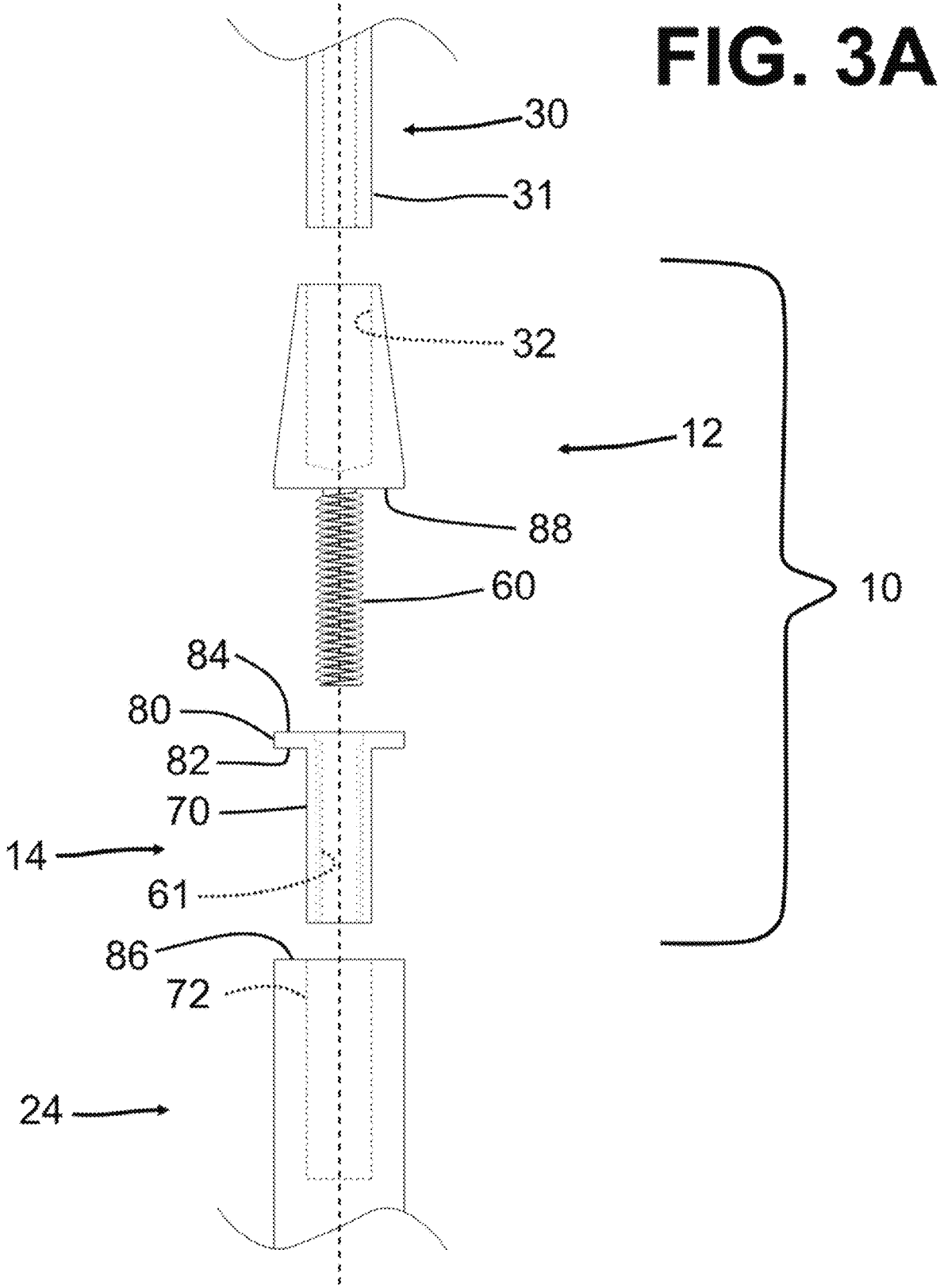
FIG. 3A is an exploded side view of the connector shown in FIG. 1, which is shown in association with a golf club shaft and a golf club head in accordance with one embodiment of the present invention.
Figure 3B:
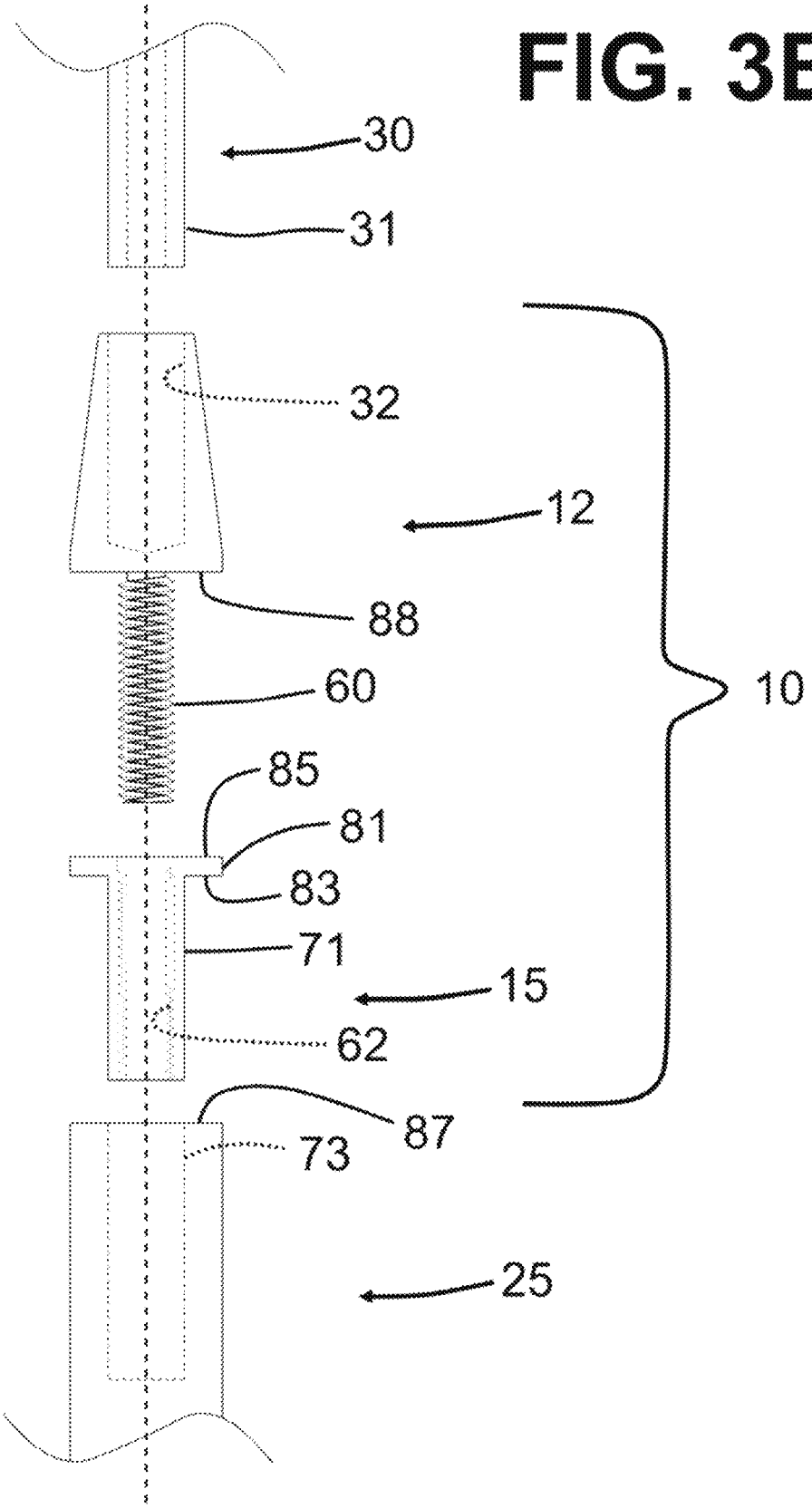
FIG. 3B is an exploded side view of the connector shown in FIG. 2, which is shown in association with a golf club shaft and a golf club head in accordance with one embodiment of the present invention.

FIG. 3A depicts one aspect of the exemplary connector 10. The connector 10 includes a shaft-mount 12, and is shown to have a right-handed head-mount 14. The right-handed head-mount 14 is adapted to be secured in the right-handed club head hosel 24. FIG. 3B depicts another aspect of the exemplary connector 10. The connector 10 includes the shaft-mount 12, and is shown to have a left-handed head-mount 15. The left-handed head-mount 15 is adapted to be secured in the left-handed club head hosel 25. The shaft-mount 12 includes a shaft-mount bore 32 that is sized to receive an end portion of the shaft 30. An outer surface 31 of the shaft 30 is secured with an adhesive (not shown) within the shaft-mount bore 32. The shaft-mount 12 further includes a first threaded coupling member in the form of a shaft or stem that features external male left-handed threads and right-handed threads 60 intersecting (or overlapping) on the same surface. This threading allows the shaft-mount 12 to threadingly mate with the right-handed head-mount 14 or the left-handed head-mount 15 to form a releasable connection.

In FIG. 3A, the right-handed head-mount 14 features female, left-handed threads 61 so that the maximum torque on the golf club during a golf swing tends to tighten the releasable connection between the shaft-mount 12 and the right-handed head-mount 14. The right-handed head-mount 14 incudes a second threaded coupling member sized to threadingly mate with the first threaded coupling member to form a releasable connection of the right-handed head-mount 14 and shaft-mount 12. In the depicted aspect, the second threaded coupling member is a right-handed head-mount stem 70, an inner surface of which includes the female, left-handed threads 61, sized to be securely received within a right-handed club head hosel bore 72, e.g., with an adhesive (not shown). The right-handed head-mount 14 can also include a flange 80. When the right-handed head-mount 14 is secured to the right-handed club head hosel 24, a bottom surface 82 of the flange 80 abuts against an upper surface 86 of the right-handed club head hosel 24. When the male, intersecting left-handed threads and right-handed threads 60 of the shaft-mount 12 mate with the female, left-handed threads 61 of the right-handed head-mount 14, an upper surface 84 of the flange 80 abuts against a bottom surface 88 of the shaft-mount 12. This abutment prevents axial and rotational movement between the shaft-mount 12 and the right-handed head-mount 14.

Similarly, in FIG. 3B, the left-handed head-mount 15 features female, right-handed threads 62 so that the maximum torque on the golf club during a golf swing tends to tighten the releasable connection between the shaft-mount 12 and the left-handed head-mount 15. The left-handed head-mount 15 incudes a second threaded coupling member sized to threadingly mate with the first threaded coupling member to form a releasable connection of the left-handed head-mount 15 and shaft-mount 12. A left-handed head-mount stem 71 (i.e., the second threaded coupling member) of the left-handed head-mount 15, an inner surface of which includes the female, right-handed threads 62, is sized to be securely received within a left-handed club head hosel bore 73, e.g., with an adhesive (not shown). The left-handed head-mount 15 can also include a flange 81. When the left-handed head-mount 15 is secured to the left-handed club head hosel 25, a bottom surface 83 of the flange 81 abuts against an upper surface 87 of the left-handed club head hosel 25. When the male, intersecting left-handed threads and right-handed threads 60 of the shaft-mount 12 mate with the female, right-handed threads 62 of the left-handed head-mount 15, an upper surface 85 of the flange 81 abuts against the bottom surface 88 of the shaft-mount 12. This abutment prevents axial and rotational movement between the shaft-mount 12 and the left-handed head-mount 15.

Figure 3C:
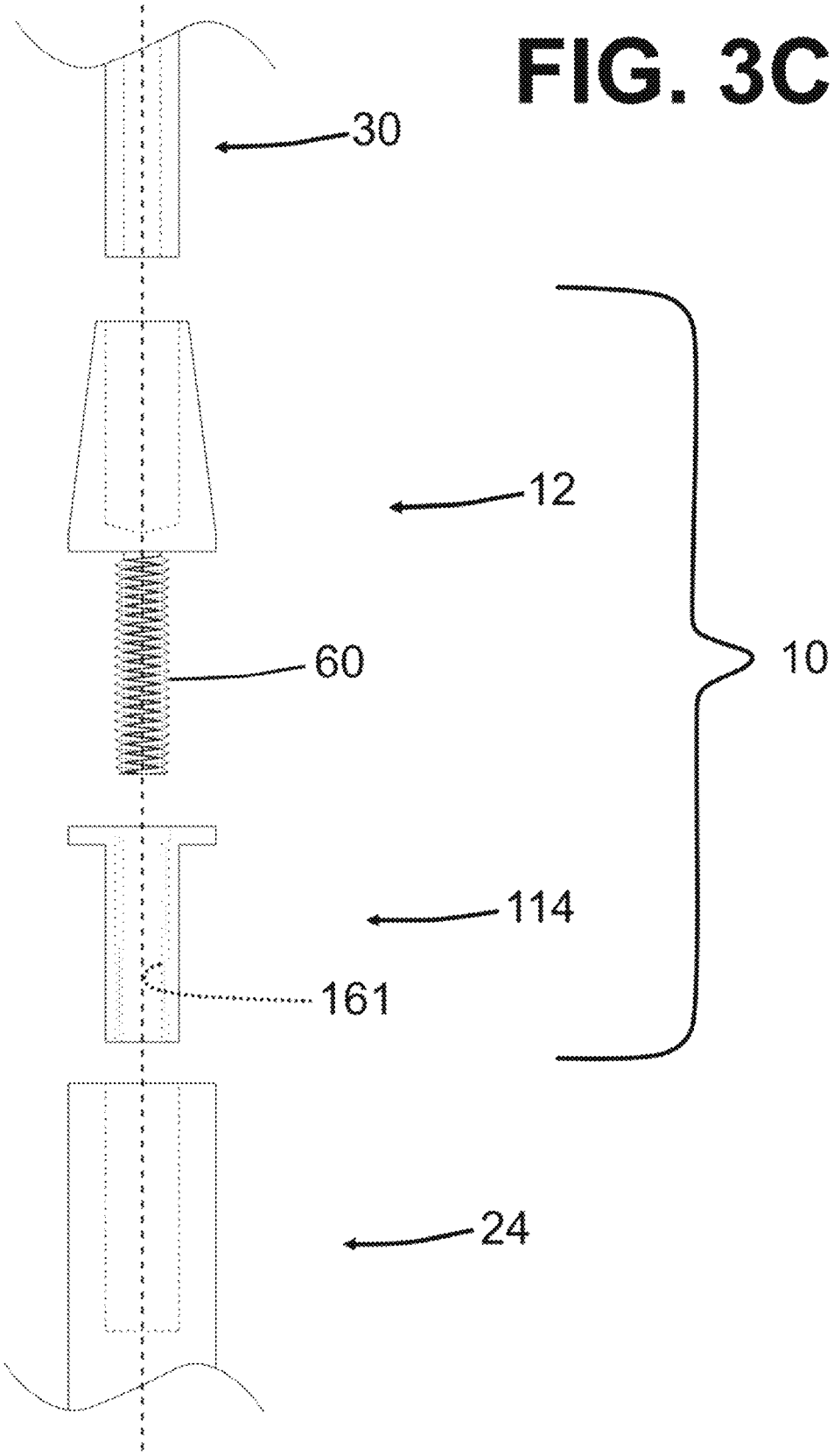
FIG. 3C is an exploded side view of the connector shown in FIG. 1, which is shown in association with a golf club shaft and a golf club head in accordance with one embodiment of the present invention.
Figure 3D:
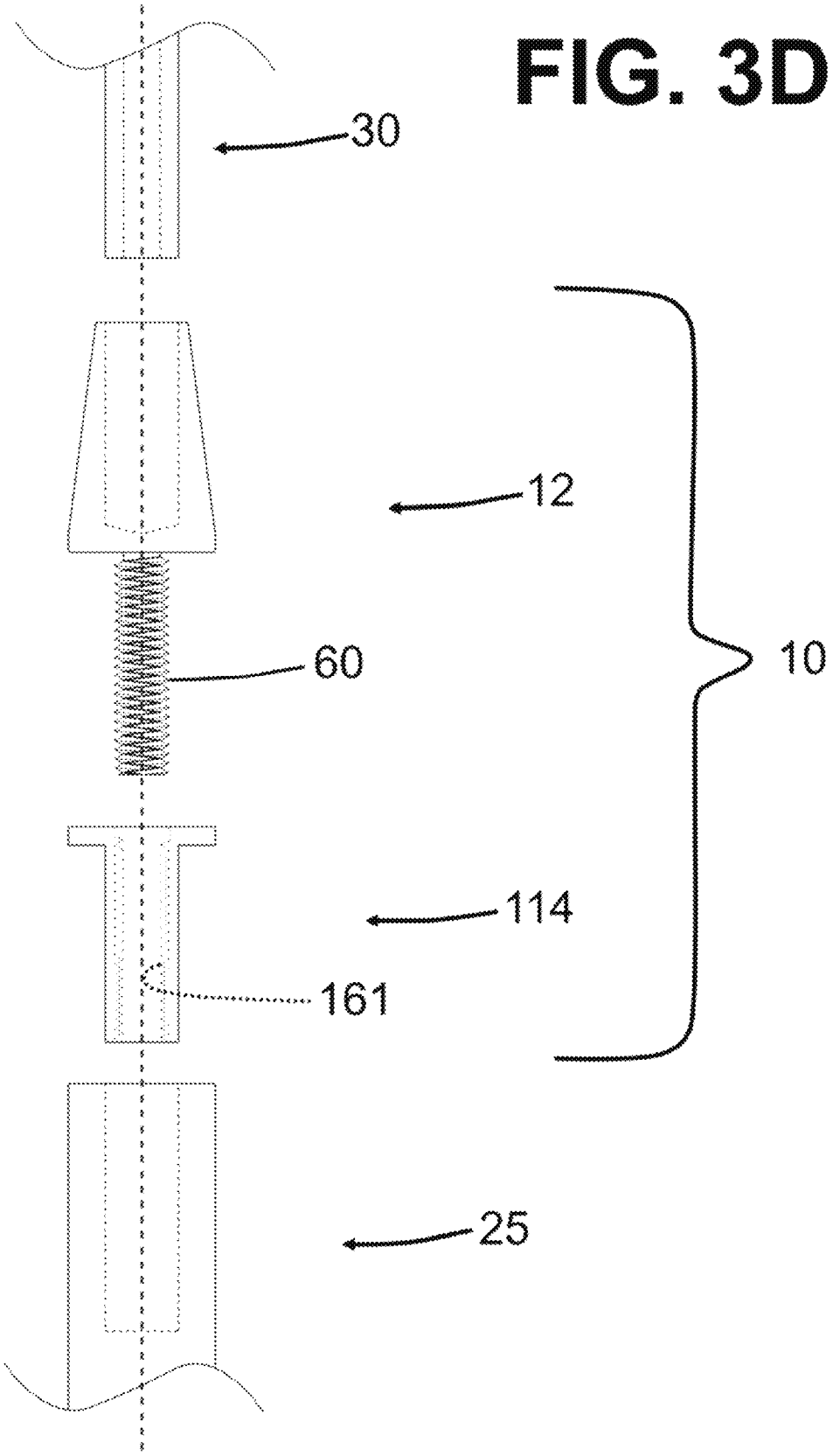
FIG. 3D is an exploded side view of the connector shown in FIG. 2, which is shown in association with a golf club shaft and a golf club head in accordance with one embodiment of the present invention.

FIGS. 3C and 3D depict another aspect of the exemplary connector 10. The connector 10 includes the shaft-mount 12 having the male, intersecting left-handed and right-handed threads 60, and a universal head-mount 114. The universal head-mount 114 is adapted be secured within the right-handed club head hosel 24 or the left-handed club head hosel 25. The depicted universal head-mount 114 includes a second threaded coupling member in the form of a head-mount stem, an inner surface of which includes female, intersecting (or overlapping) left-handed threads and right-handed threads 161. The female, intersecting left-handed and right-handed threads 161 threadingly mate with the first threaded coupling member (i.e., the male, intersecting left-handed and right-handed threads 60) to form a releasable connection of the universal head-mount 114 and shaft-mount 12. Therefore, the shaft-mount 12 can threadingly mate with the universal head-mount 114 by either right-handed thread convention or left-handed thread convention. As such, a single head-mount and a single shaft-mount can be used for left-handed club heads or right-handed club heads.

Figure 4A:
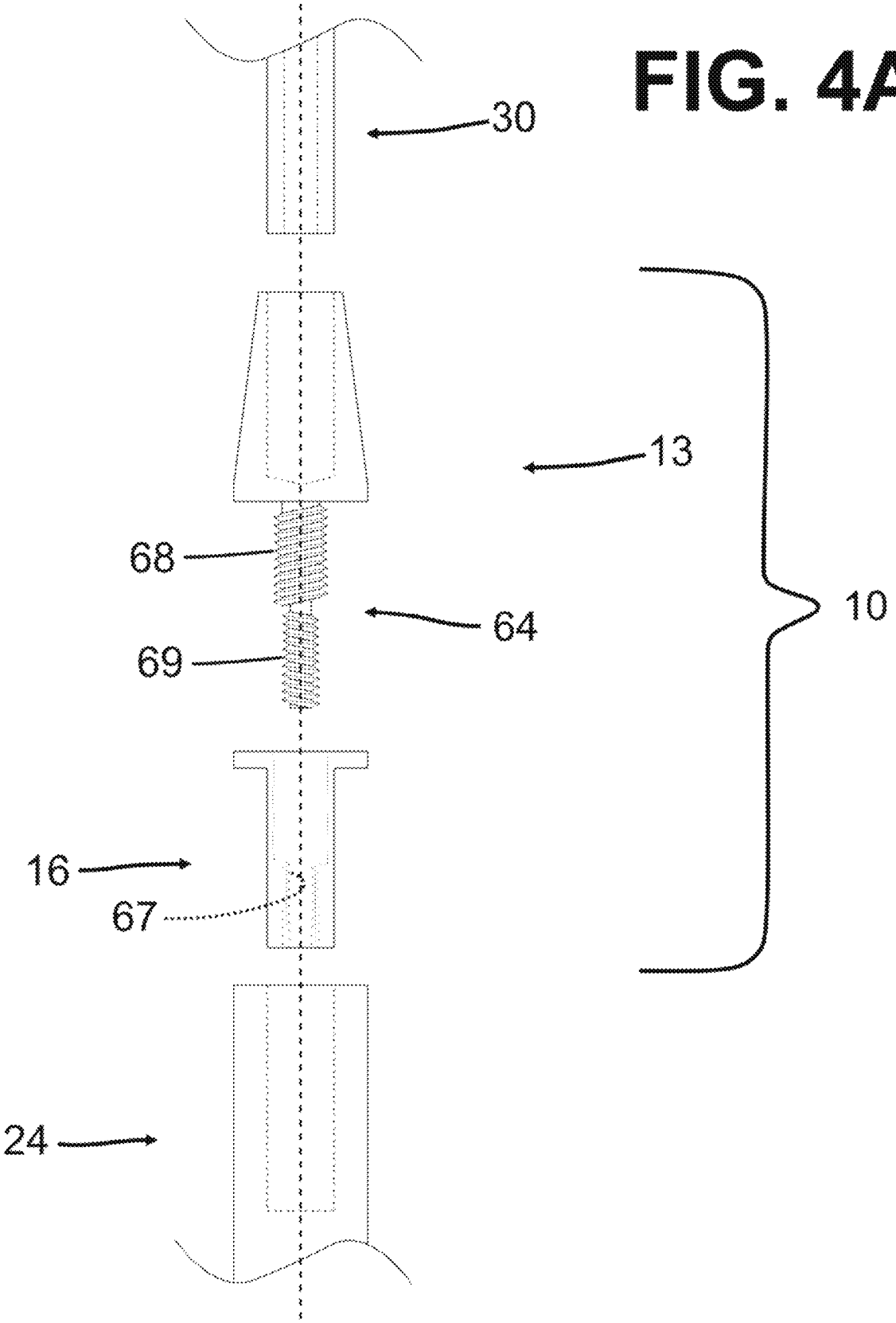
FIG. 4A is an exploded side view of the connector shown in FIG. 1, which is shown in association with a golf club shaft and a golf club head in accordance with another embodiment of the present invention.
Figure 4B:
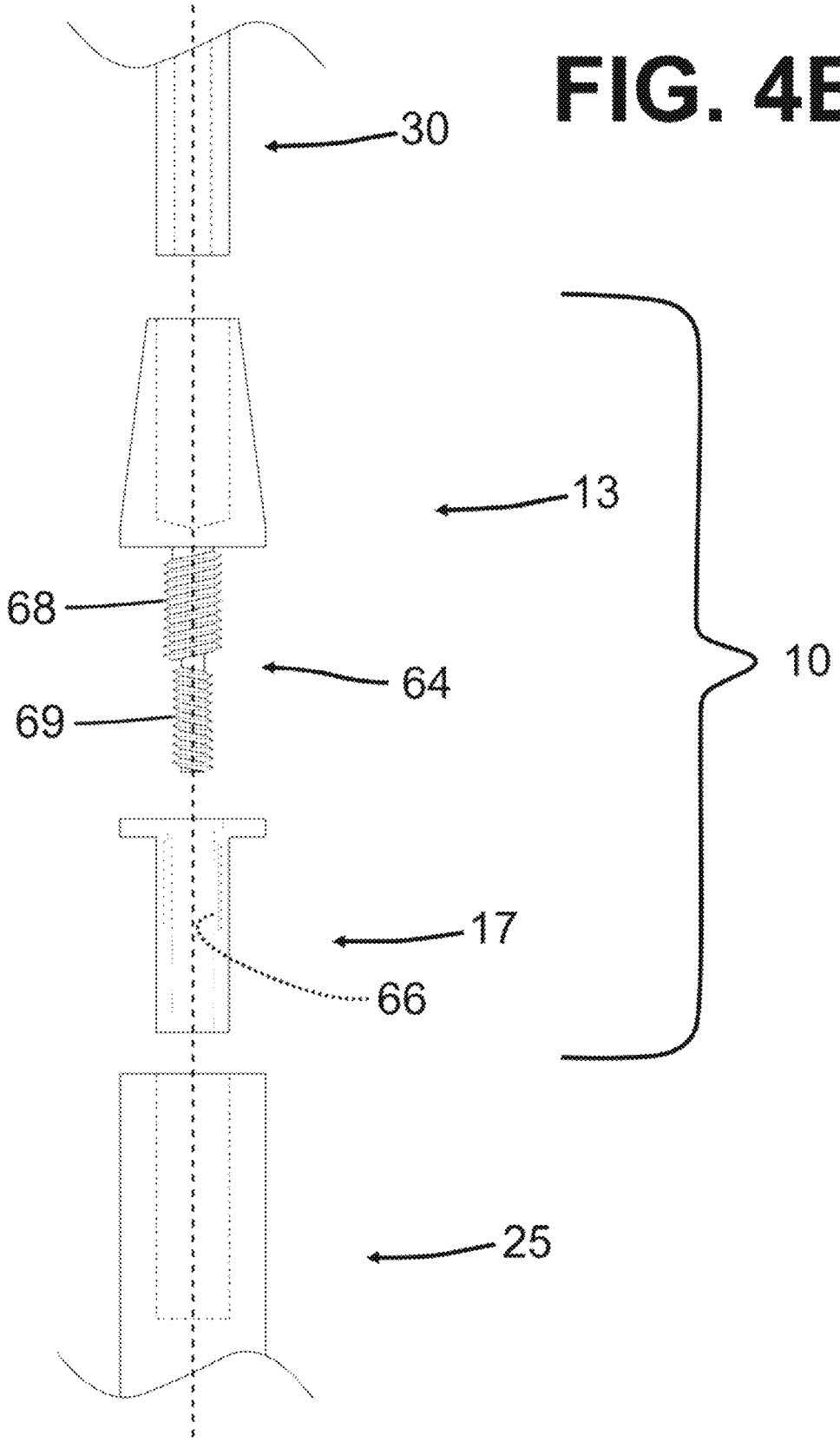
FIG. 4B is an exploded side view of the connector shown in FIG. 2, which is shown in association with a golf club shaft and a golf club head in accordance with another embodiment of the present invention.

FIG. 4A depicts another aspect of the exemplary connector 10. The connector 10 includes a shaft-mount 13, and is shown to have a right-handed head-mount 16 that is intended to be secured into the right-handed club head hosel 24. FIG. 4B depicts another aspect of the exemplary connector 10, wherein the connector 10 includes the shaft-mount 13, and is shown to have a left-handed head-mount 17 that is intended to be secured in the left-handed club head hosel 25. The shaft-mount 13 includes a first threaded coupling member in the form of a threaded shaft or stem 64. The threaded stem 64 includes a first section formed with male, right-handed threads 68 and a second section formed with male, left-handed threads 69. The first and second sections are axially spaced such that male, right-handed threads 68 and male, left-handed threads 69 are staggered on the stem 65 (i.e., the male, right-handed threads 68 and male, left-handed threads 69 are not intersecting or overlapping on stem 64). It should be appreciated that the major diameter of the male, right-handed threads 68 can differ from the major diameter of the male, left-handed threads 69.

In FIG. 4A, the right-handed head-mount 16 includes a second threaded coupling member in the form of a stem or sleeve having an inner surface defining a bore sized and dimensioned to receive the threaded stem 64 of the shaft-mount 13. The inner surface includes a first section corresponding the first section of the stem 64 and a second section corresponding with the second section of the stem 64. The first section of the inner surface is substantially smooth (i.e., devoid of threads) to avoid engagement with the male, right-handed threads 68 of the stem 64. The male, left-handed threads 69 of the stem mate with female, left-handed threads 67 formed on the second section of the inner surface to form a releasable connection between the shaft-mount 13 and the right-handed head-mount 16. And the threading engagement between the male, left-handed threads 69 and the female, left-handed threads 67 ensures that the maximum torque on the golf club during a golf swing tends to tighten the releasable connection between the shaft-mount 13 and the right-handed head-mount 16.

Similarly, in FIG. 4B the left-handed head-mount 17 includes a second threaded coupling member in the form of a stem or sleeve having an inner surface defining a bore sized and dimensioned to receive the threaded stem 64 of the shaft-mount 13. The inner surface includes a first section corresponding the first section of the stem 64 and a second section corresponding with the second section of the stem 64. The second section of the inner surface is substantially smooth (i.e., devoid of threads) to avoid engagement with the male, left-handed threads 69 of the stem 64. The male, right-handed threads 68 of the stem mate with female, right-handed threads 66 formed on the first section of the inner surface to form a releasable connection between the shaft-mount 13 and the left-handed head-mount 17. And the threading engagement between the male, right-handed threads 68 and the female, right-handed threads 66 ensures that the maximum torque on the golf club during a golf swing tends to tighten the releasable connection between the shaft-mount 13 and the left-handed head-mount 17.

Regarding the embodiment of FIGS. 4A and 4B, it should be appreciated that the order of staggered right-handed threads 68 and left-handed threads 69 on the threaded stem 64 of the shaft-mount 13 can be reversed. Accordingly, the order of the female, left-handed threads 67 and female, right-handed threads 66 on the respective right-handed head-mount 16 and the left-handed head-mount 17 can be reversed.

Figure 5A:
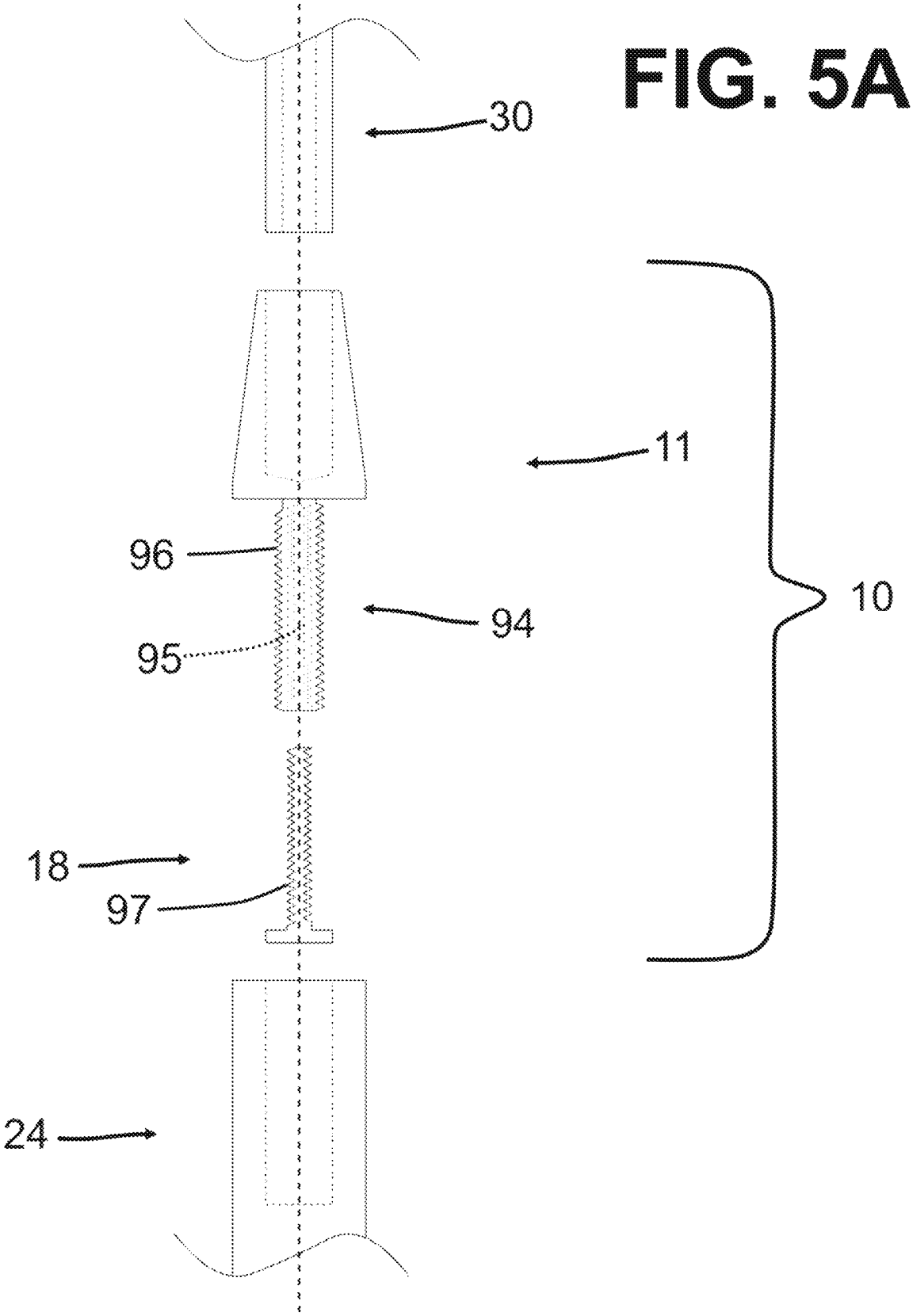
FIG. 5A is an exploded side view of the connector shown in FIG. 1, which is shown in association with a golf club shaft and a golf club head in accordance with another embodiment of the present invention.
Figure 5B:
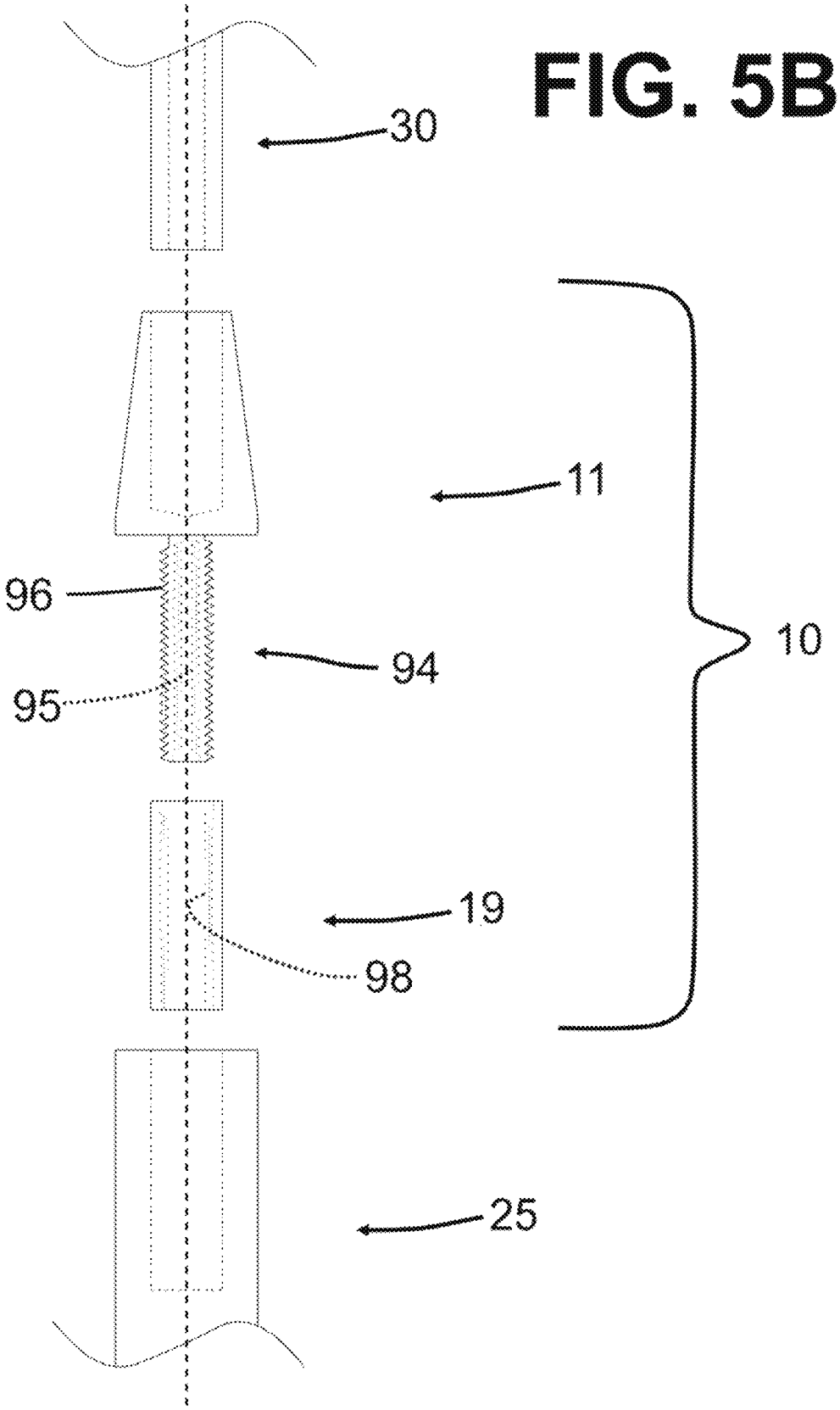
FIG. 5B is an exploded side view of the connector shown in FIG. 2, which is shown in association with a golf club shaft and a golf club head in accordance with another embodiment of the present invention.

FIG. 5A depicts another aspect of the exemplary connector 10. The connector 10 includes a shaft-mount 11 and a right-handed head-mount 18 that is adapted to be secured into a right-handed club head hosel 24. FIG. 5B depicts another aspect of the exemplary connector 10 including the shaft-mount 11 and a left-handed head-mount 19 that is intended to be secured in a left-handed club head hosel 25. The shaft-mount 11 includes a first threaded coupling member in the form of a threaded stem or sleeve 94 having an outer surface and an inner surface defining a bore. The outer surface of the stem 94 includes male, right-handed threads 96 and the inner surface of the stem 94 includes female, left-handed threads 95. The male, right-handed threads 96 and the female, left-handed threads 95 are arranged concentric to one another.

In FIG. 5A, the right-handed head-mount 18 includes a second threaded coupling member featuring a shaft formed with male, left-handed threads 97 so that the maximum torque on the golf club during a golf swing tends to tighten the releasable connection between the shaft-mount 11 and the right-handed head-mount 18. The female, left-handed threads 95 on the inner surface of the stem 94 mate with the male, left-handed threads 97 to form a releasable connection between the shaft-mount 11 and the right-handed head-mount 18.

In FIG. 5B, the left-handed head-mount 19 includes a second threaded coupling member featuring a stem or sleeve having an inner surface formed with female, right-handed threads 98 so that the maximum torque on the golf club during a golf swing tends to tighten the releasable connection between the shaft-mount 11 and the left-handed head-mount 19. The male, right-handed threads 96 on the outer surface of the stem 94 mate with the female, right-handed threads 98 to form a releasable connection between the shaft-mount 11 and the left-handed head-mount 19.

It should be appreciated that the order of the concentric right-handed threads 96 and left-handed threads 95 on the stem 94 can be reversed. Accordingly, the right-handed head-mount 18 would change to resemble the shape of the left-handed head-mount 19 depicted in FIG. 5B, and feature female, left-handed threads. And the left-handed head-mount 19 would change to resemble the shape of the right-handed head-mount 18 depicted in FIG. 5A, and feature male, right-handed threads. Further, the right-handed and left-handed head-mounts 18, 19 are shown in FIGS. 5A and 5B without a flange to abut against the shaft-mount 11. As such, the bottom surface of the shaft-mount 11 would abut against the upper surface of each hosel 24, 25 of the club head to prevent axial and rotational movement between the shaft-mount and respective head-mount. In similar embodiments, a flange can be featured on one or both head-mounts to abut against the shaft-mount.

Figure 6A:
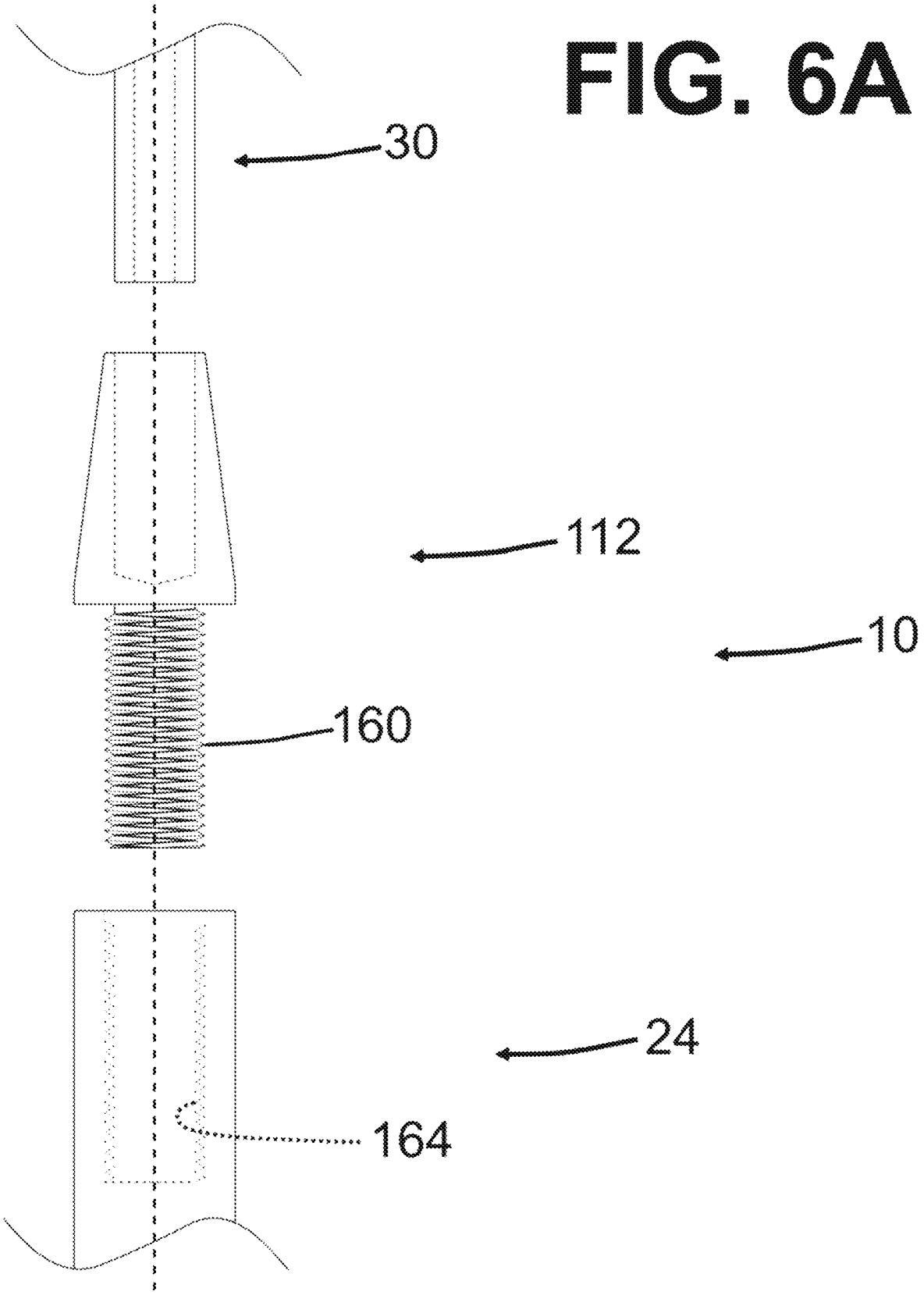
FIG. 6A is an exploded side view of the connector shown in FIG. 1, which is shown in association with a golf club shaft and a golf club head in accordance with another embodiment of the present invention.
Figure 6B:
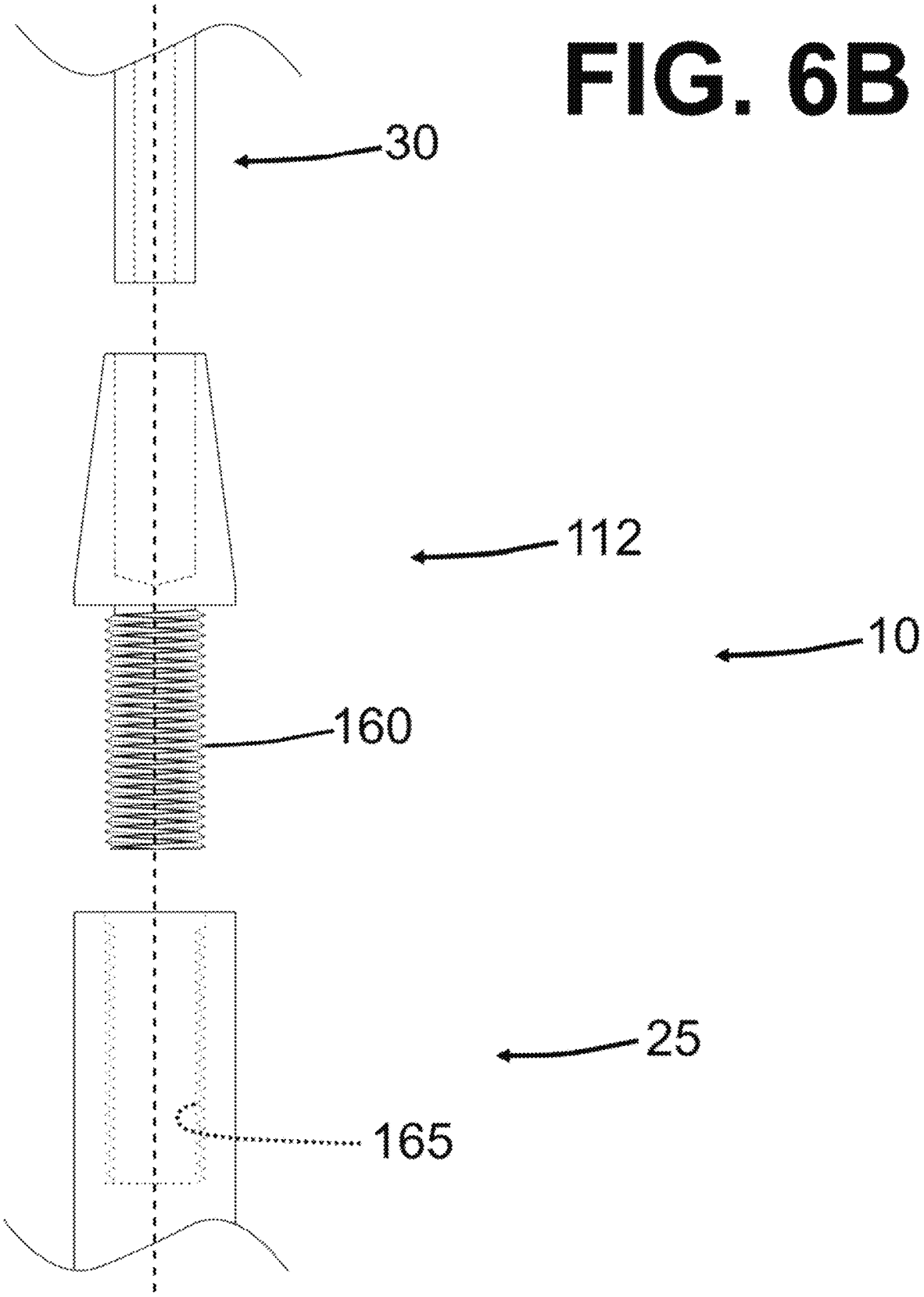
FIG. 6B is an exploded side view of the connector shown in FIG. 2, which is shown in association with a golf club shaft and a golf club head in accordance with another embodiment of the present invention.

FIGS. 6A and 6B depict another aspect of the exemplary connector 10. The connector 10 includes a shaft-mount 112 having a first threaded coupling member in the form of a shaft or stem that features external male left-handed threads and right-handed threads 160 intersecting (or overlapping) on the same surface. In FIG. 6A, a right-handed club head hosel 24 includes a second threaded coupling member sized to threadingly mate with the first threaded coupling member to form a releasable connection of the right-handed club head hosel 24 and shaft-mount 112. The second threaded coupling member features female, left-handed threads 164 so that the maximum torque on the golf club during a golf swing tends to tighten the releasable connection between the shaft-mount 112 and the right-handed club-head hosel 24. Similarly, in FIG. 6B a left-handed club head hosel 25 includes a second threaded coupling member sized to threadingly mate with the first threaded coupling member to form a releasable connection of the left-handed club head hosel 25 and shaft-mount 112. The second threaded coupling member features female, right-handed threads 165 so that the maximum torque on the golf club during a golf swing tends to tighten the releasable connection between the shaft-mount 112 and the left-handed club-head hosel 25.

Figure 7A:
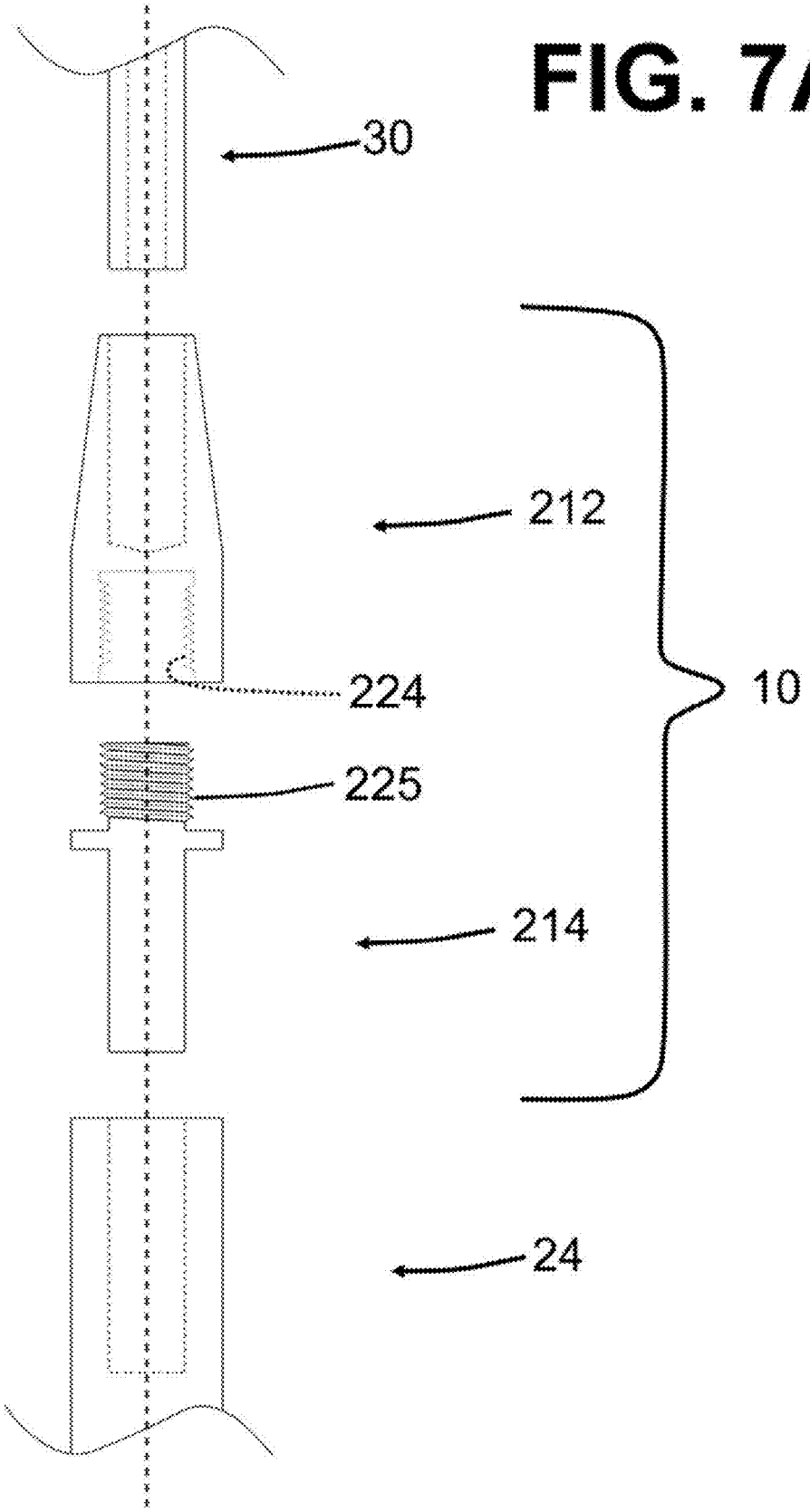
FIG. 7A is an exploded side view of the connector shown in FIG. 1, which is shown in association with a golf club shaft and a golf club head in accordance with another embodiment of the present invention.

FIG. 7A depicts another aspect of the exemplary connector 10. The connector 10 includes a shaft-mount 212 and a right-handed head-mount 214 adapted to be secured in a right-handed club head hosel 24. The shaft-mount 212 includes a first threaded coupling member defined by an inner surface having intersecting (or overlapping) female left-handed threads and right-handed threads 224. As shown, the inner surface defines a threaded bore. In FIG. 7A, the right-handed head-mount 214 incudes a second threaded coupling member sized to threadingly mate with the first threaded coupling member to form a releasable connection of the right-handed head-mount 214 and shaft-mount 212. In the depicted aspect, the right-handed head-mount 214 features a stem sized to be received within the threaded bore of the shaft-mount 212. The stem is formed with male, left-handed threads 225 which mate with the intersecting (or overlapping) female left-handed threads and right-handed threads 224 so that the maximum torque on the golf club during a golf swing tends to tighten the releasable connection between the shaft-mount 212 and the right-handed head-mount 214.

Figure 7B:
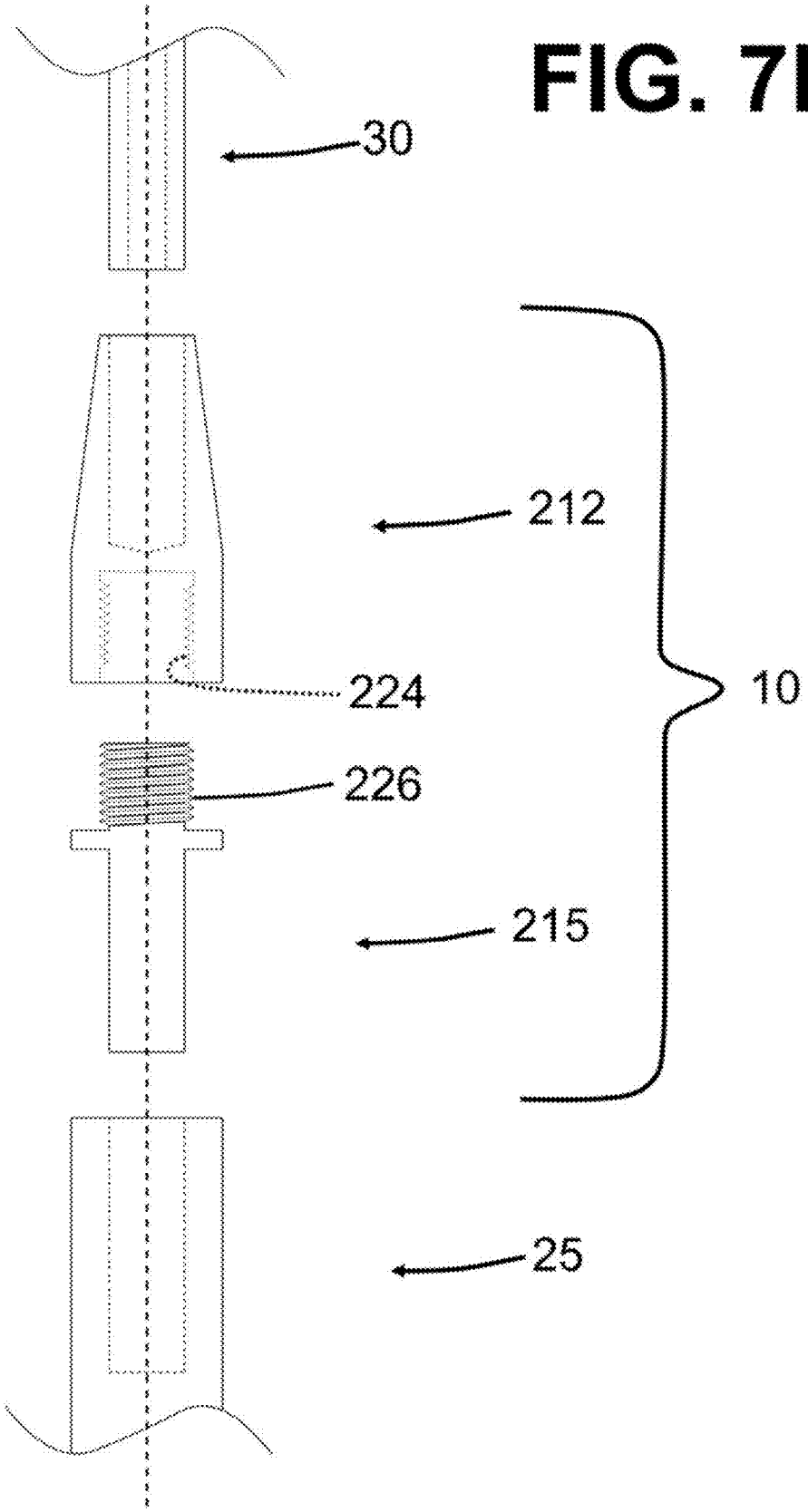
FIG. 7B is an exploded side view of the connector shown in FIG. 2, which is shown in association with a golf club shaft and a golf club head in accordance with another embodiment of the present invention.

FIG. 7B depicts another aspect of the exemplary connector 10 wherein the connector 10 includes the shaft-mount 212 and a left-handed head-mount 215 adapted to be secured in a left-handed club head hosel 25. In FIG. 7B, the left-handed head-mount 215 incudes a second threaded coupling member sized to threadingly mate with the first threaded coupling member to form a releasable connection of the left-handed head-mount 215 and shaft-mount 212. In the depicted aspect, the left-handed head-mount 215 features a stem sized to be received within the threaded bore of the shaft-mount 212. The stem is formed with male, right-handed threads 226 which mate with the intersecting (or overlapping) female left-handed threads and right-handed threads 224 so that the maximum torque on the golf club during a golf swing tends to tighten the releasable connection between the shaft-mount 212 and the left-handed head-mount 215.

Figure 7C:
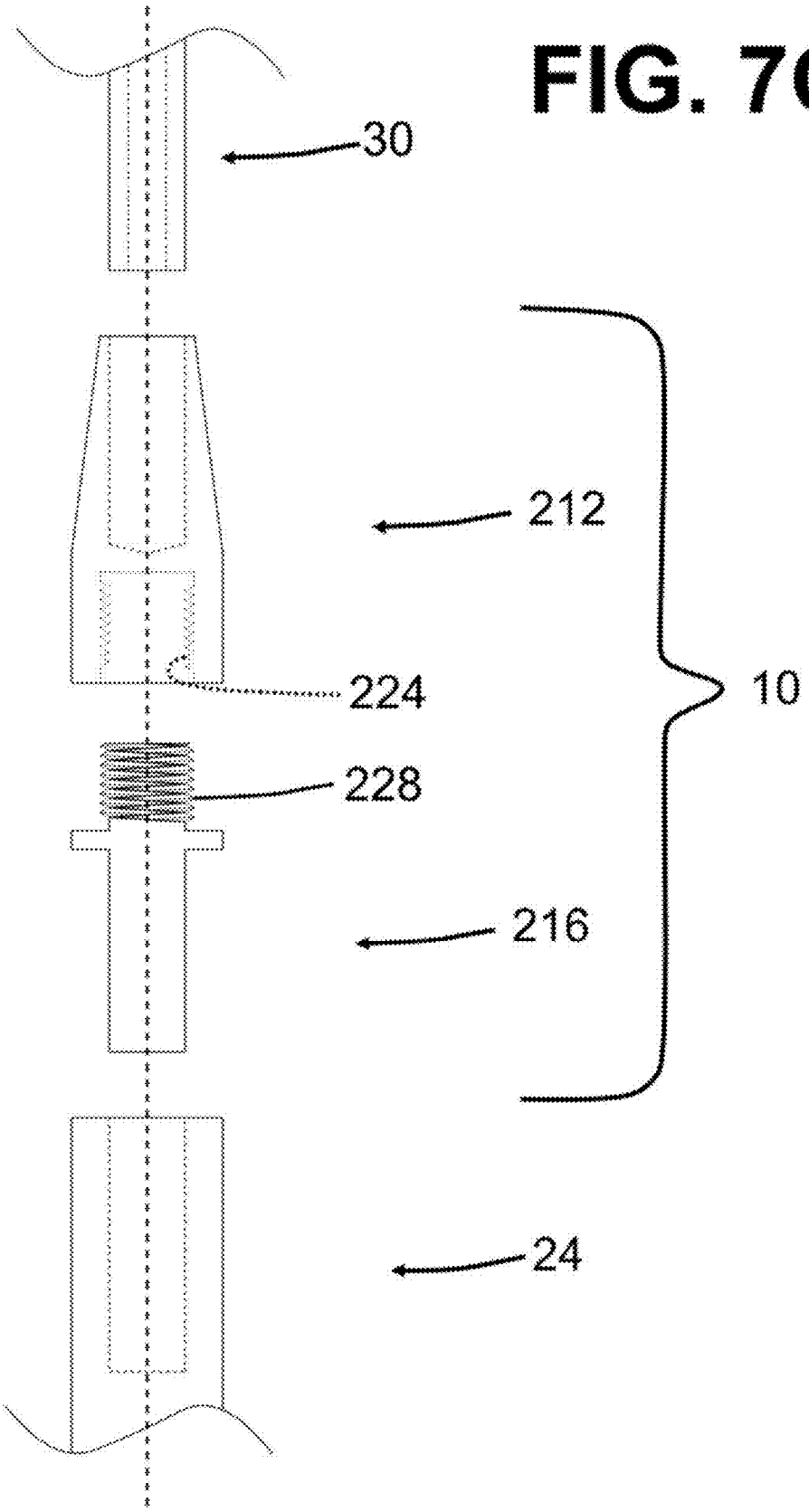
FIG. 7C is an exploded side view of the connector shown in FIG. 1, which is shown in association with a golf club shaft and a golf club head in accordance with another embodiment of the present invention.
Figure 7D:
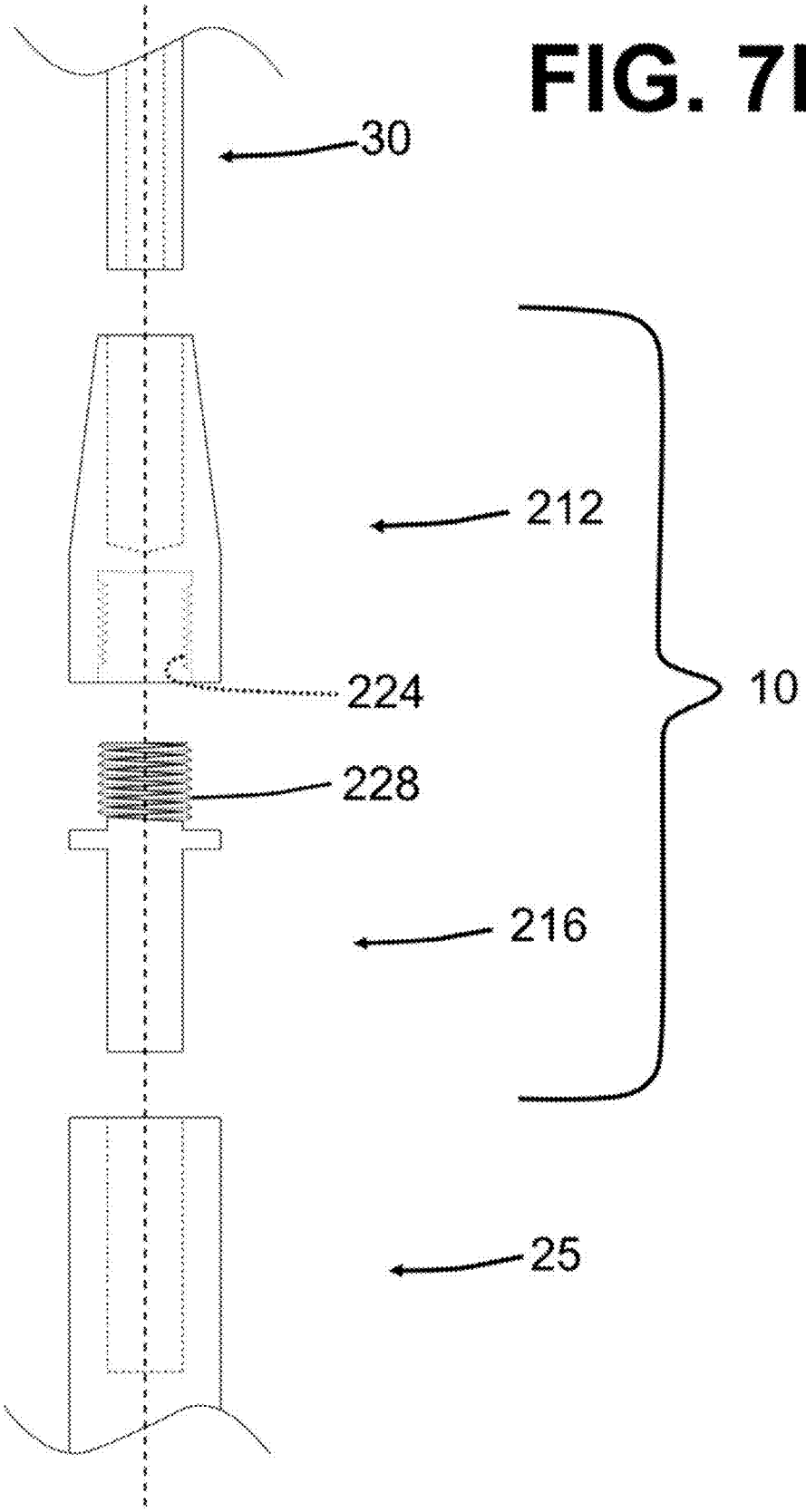
FIG. 7D is an exploded side view of the connector shown in FIG. 2, which is shown in association with a golf club shaft and a golf club head in accordance with another embodiment of the present invention.

FIGS. 7C and 7D depict another aspect of the exemplary connector 10 wherein the connector 10 includes the shaft-mount 212 and a universal head-mount 216 adapted be secured within the right-handed club head hosel 24 or left-handed club head hosel 25. The universal head-mount 216 incudes a second threaded coupling member sized to threadingly mate with the first threaded coupling member to form a releasable connection of the universal head-mount 216 and shaft-mount 212. In the depicted aspect, the universal head-mount 216 features a stem sized to be received within the threaded bore of the shaft-mount 212. The stem is formed with male, intersecting (or overlapping) left-handed and right-handed threads 228 which mate with the intersecting (or overlapping) female, left-handed and right-handed threads 224 of the shaft-mount 212. Therefore, the shaft-mount 212 can threadingly mate with the universal head-mount 216 by either right-handed thread convention or left-handed thread convention. As such, a single head-mount and a single shaft-mount can be used for left-handed club heads or right-handed club heads.

Figure 8A:
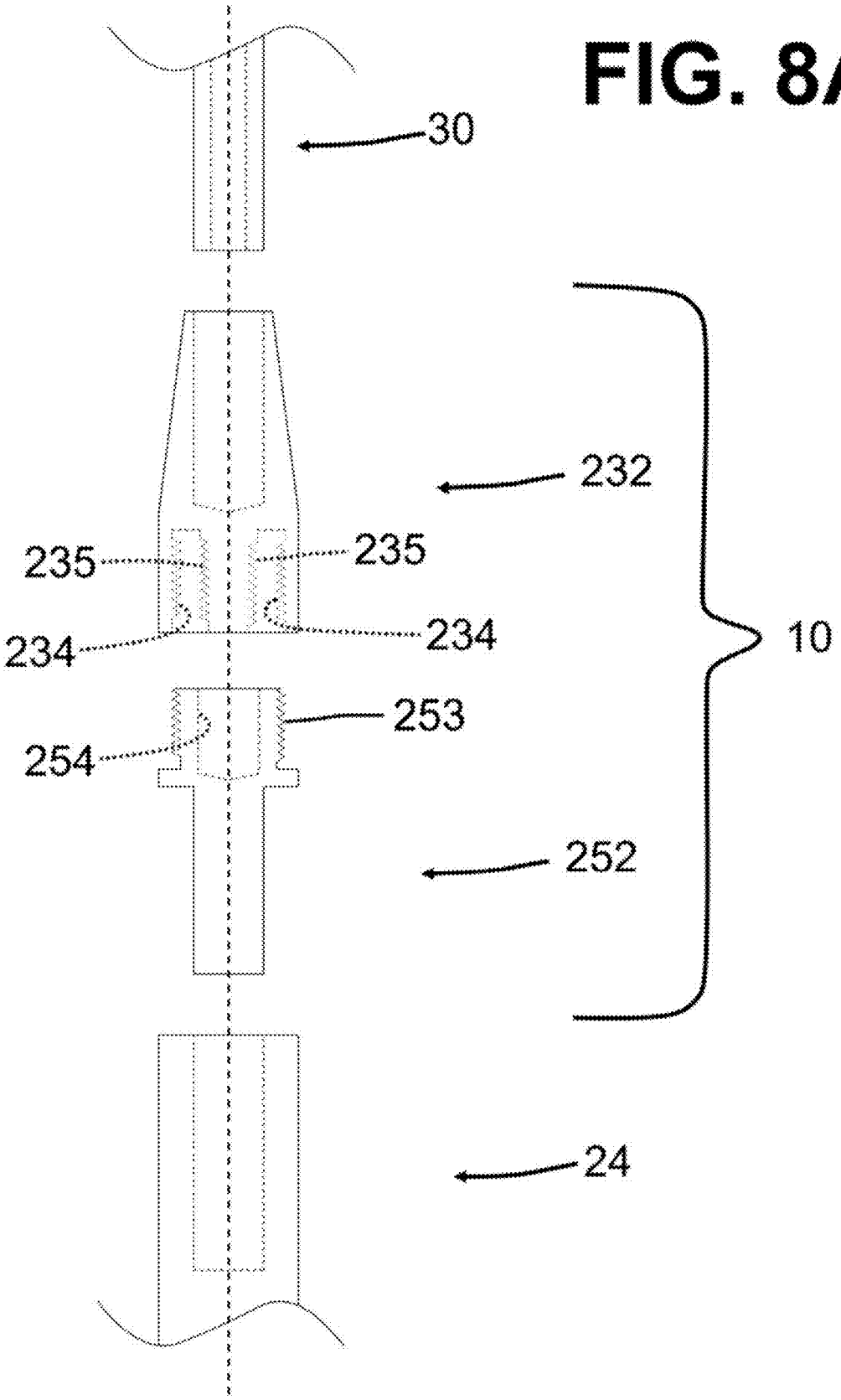
FIG. 8A is an exploded side view of the connector shown in FIG. 1, which is shown in association with a golf club shaft and a golf club head in accordance with another embodiment of the present invention.

FIG. 8A depicts another aspect of the exemplary connector 10. The connector 10 includes a shaft-mount 232 and a right-handed head-mount 252 adapted to be secured in a right-handed club head hosel 24. The shaft-mount 232 includes an inner surface defining a threaded bore. A stem is provided within the threaded bore, with an outer surface of the stem spaced radially inward of the inner surface relative to a center axis of the shaft-mount. The inner surface defining the threaded bore features female, left-handed threads 234, and the outer surface of the stem features male, right-handed threads 235. The threads 234, 235 together define a first threaded coupling member of the shaft-mount 232.

In FIG. 8A, the right-handed head-mount 252 incudes a second threaded coupling member sized to threadingly mate with the first threaded coupling member to form a releasable connection of the right-handed head-mount 252 and shaft-mount 232. As depicted, the second threaded coupling member includes a stem or sleeve sized to be received in the threaded bore of the shaft-mount 232, the sleeve having an outer surface and an inner surface defining a bore sized to receive the stem of the shaft-mount 232. The outer surface features male, left-handed threads 253 and the inner surface 254 is substantially smooth (i.e. devoid of threads) to avoid engagement with the male, right-handed threads 235 of the shaft-mount 232. The male, left-handed threads 253 threadingly engage the female, left-handed threads 234 so that the maximum torque on the golf club during a golf swing tends to tighten the releasable connection between the shaft-mount 232 and the right-handed head-mount 252.

Figure 8B:
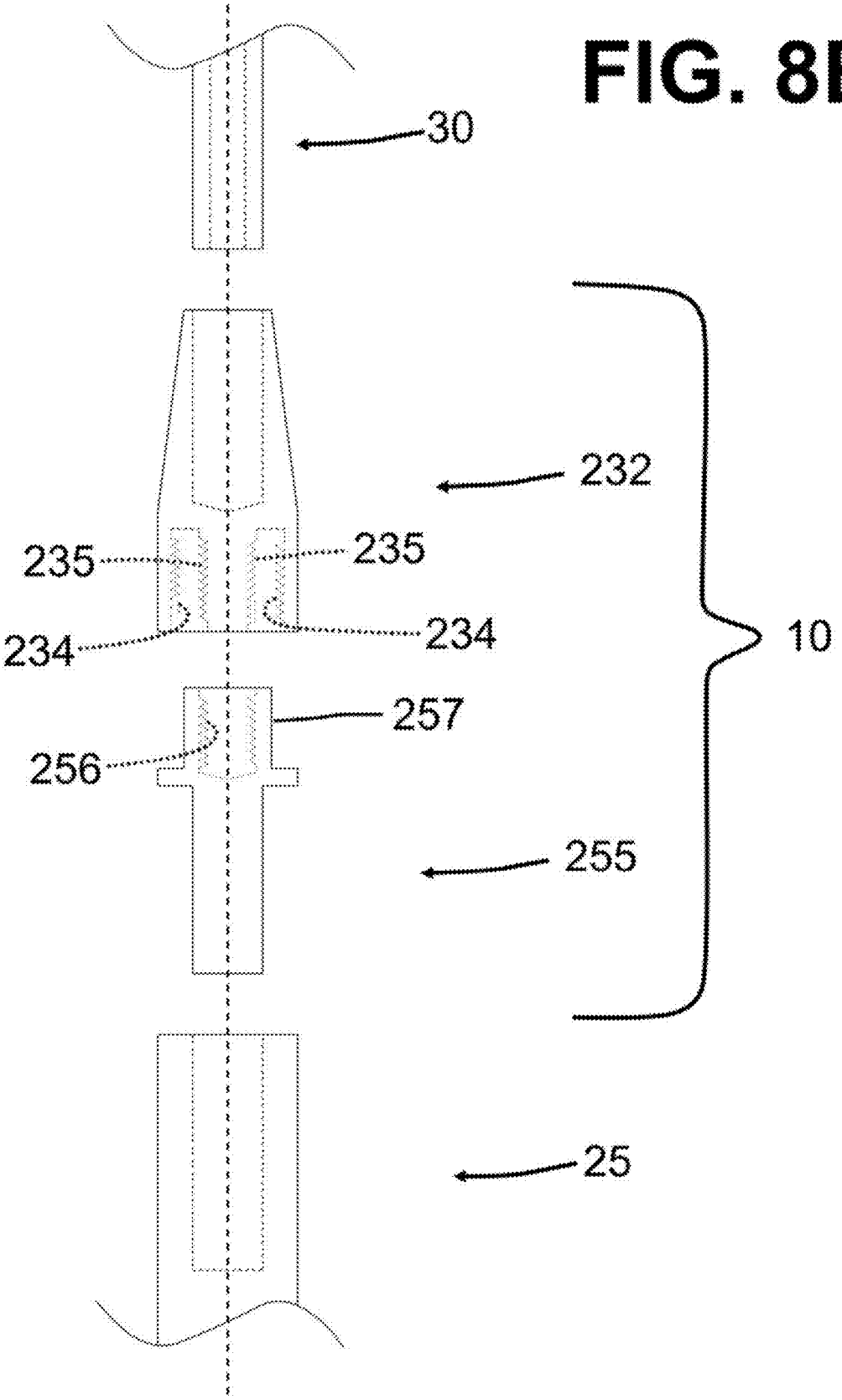
FIG. 8B is an exploded side view of the connector shown in FIG. 2, which is shown in association with a golf club shaft and a golf club head in accordance with another embodiment of the present invention.

FIG. 8B depicts another aspect of the exemplary connector 10 wherein the connector 10 includes the shaft-mount 232, and a left-handed head-mount 255 adapted to be secured in a left-handed club head hosel 25. The left-handed head-mount 255 includes a second threaded coupling member sized to threadingly mate with the first threaded coupling member to form a releasable connection of the left-handed head-mount 255 and shaft-mount 232. As depicted, the second threaded coupling member includes a stem or sleeve sized to be received in the threaded bore of the shaft-mount 232, the sleeve having an outer surface 257 and an inner surface defining a bore sized to receive the stem of the shaft-mount 232. The outer surface 257 is substantially smooth (i.e. devoid of threads) to avoid engagement with the female, left-handed threads 234 of the shaft-mount 232. The inner surface is formed with female, right-handed threads 256 which threadingly engage the male, right-handed threads 235 of the shaft-mount 232 so that the maximum torque on the golf club during a golf swing tends to tighten the releasable connection between the shaft-mount 232 and the left-handed head-mount 255.

It should be appreciated that the order of the right-handed threads 235 and left-handed threads 234 of the shaft-mount 232 can be reversed on the shaft-mount 232. Accordingly, the order and location of the right-handed threads 256 and left-handed threads 253 of the respective left-handed head-mount 255 and right-handed head-mount 252 can be reversed.

Figure 9A:
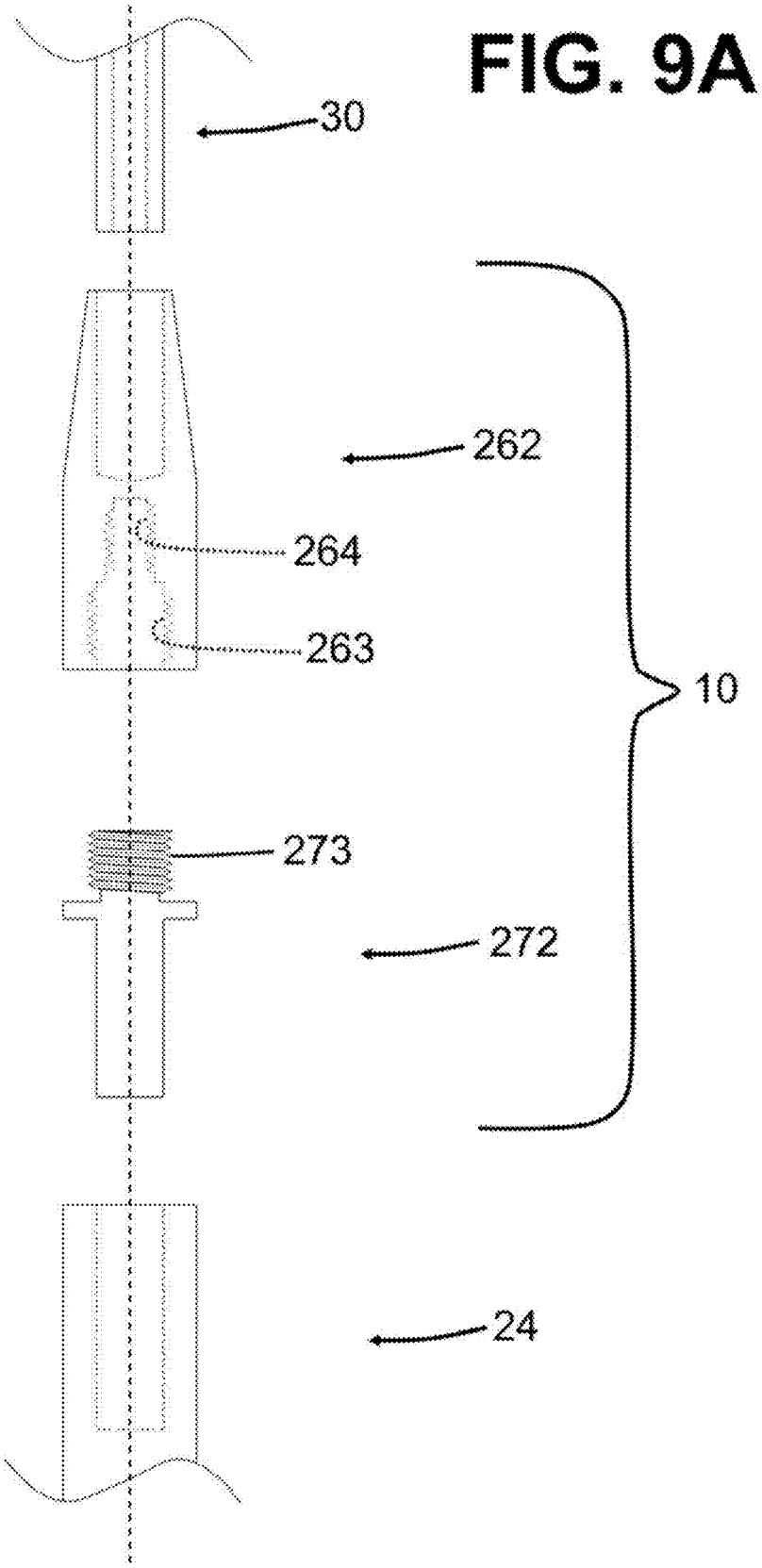
FIG. 9A is an exploded side view of the connector shown in FIG. 1, which is shown in association with a golf club shaft and a golf club head in accordance with another embodiment of the present invention.

FIG. 9A depicts another aspect of the exemplary connector 10. The connector 10 includes a shaft-mount 262 and a right-handed head-mount 272 that is adapted to be secured into a right-handed club head hosel 24. The shaft-mount 262 includes a first threaded coupling member in the form of a stem or sleeve having an outer surface and an inner surface defining a threaded bore. The inner surface of the stem includes a first section with female, left-handed threads 263 and a second section with female, right-handed threads 264. The first and second sections are axially spaced such that female, right-handed threads 264 and female, left-handed threads 263 are staggered on the inner surface of the threaded bore (i.e., the female, right-handed threads 264 and female, left-handed threads 263 are not intersecting or overlapping on the inner surface of the stem). Further, the diameter of the first section with the female, right-handed threads 264 differs from the diameter of the second section with the female, left-handed threads 263.

In FIG. 9A, the right-handed head-mount 272 includes a second threaded coupling member in the form of a stem having an outer surface with male, left-handed threads 273. The male, left-handed threads 273 mate with female, left-handed threads 263 to form a releasable connection between the shaft-mount 262 and the right-handed head-mount 272. And the threading engagement between the male, left-handed threads 273 and the female, left-handed threads 263 ensures that the maximum torque on the golf club during a golf swing tends to tighten the releasable connection between the shaft-mount 262 and the right-handed head-mount 272.

Figure 9B:
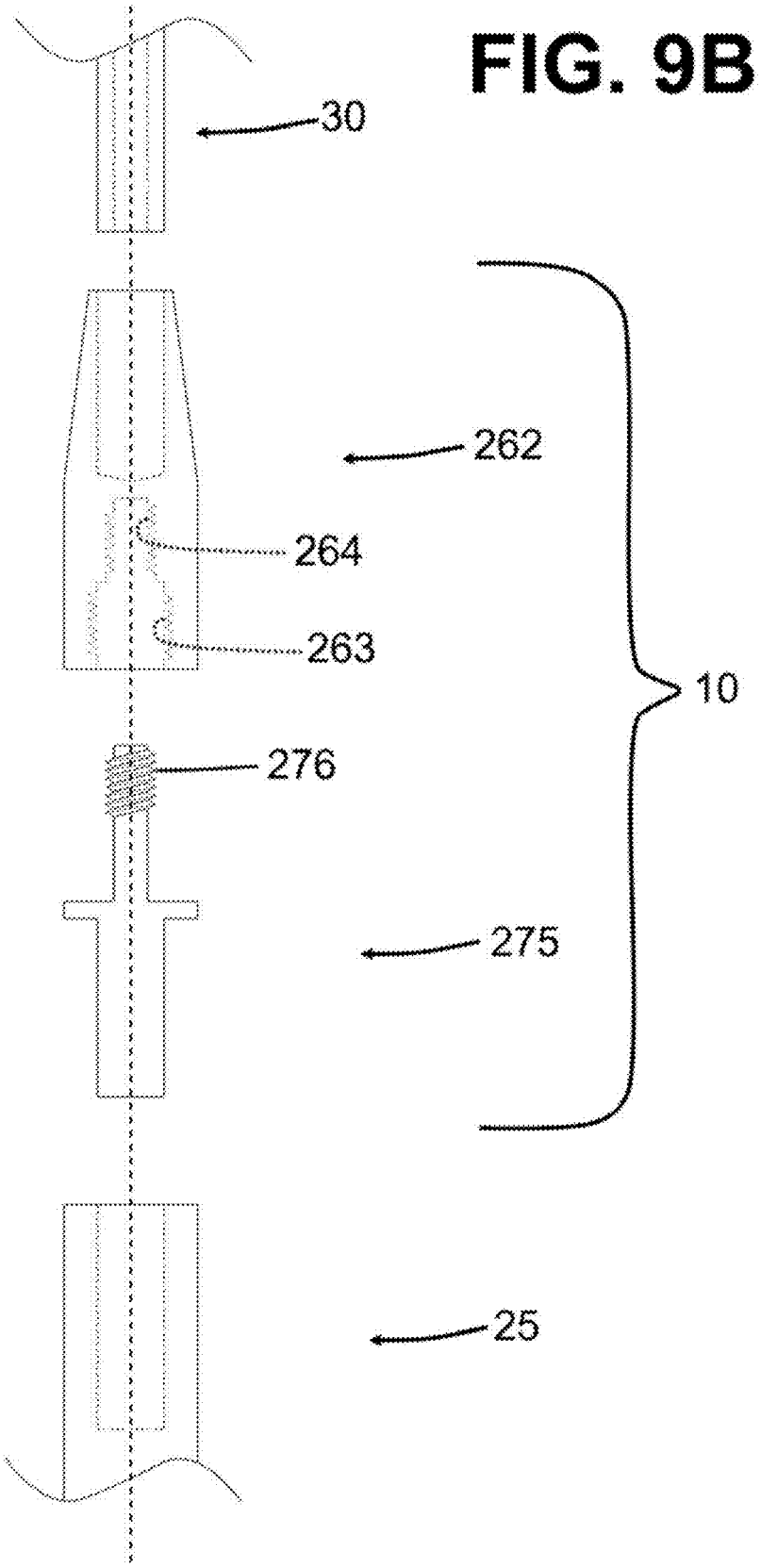
FIG. 9B is an exploded side view of the connector shown in FIG. 2, which is shown in association with a golf club shaft and a golf club head in accordance with another embodiment of the present invention.

FIG. 9B depicts another aspect of the exemplary connector 10 wherein the connector 10 includes the shaft-mount 262 and a left-handed head-mount 275 that is adapted to be secured into a left-handed club head hosel 25. The left-handed head-mount 275 includes a second threaded coupling member in the form of a stem having an outer surface with male, right-handed threads 276. The threaded stem of the head-mount 275 is sized to be received in the threaded bore of the shaft-mount 262. The size and dimensions of the threaded stem of the head-mount 275 are such that they avoid engagement with the female, left-handed threads 263 on the first section of the inner surface of the threaded bore of the shaft-mount 262. The male, right-handed threads 276 mate with female, right-handed threads 264 to form a releasable connection between the shaft-mount 262 and the left-handed head-mount 275. And the threading engagement between the male, right-handed threads 276 and the female, right-handed threads 264 ensures that the maximum torque on the golf club during a golf swing tends to tighten the releasable connection between the shaft-mount 262 and the left-handed head-mount 275.

It should be appreciated that the order of staggered female, right-handed threads 264 and female, left-handed threads 263 on the shaft-mount 262 can be reversed. Accordingly, the right-handed head-mount 272 would change to resemble the shape of the left-handed head-mount 275 depicted in FIG. 9B, with male, left-handed threads. And the left-handed head-mount 275 would change to resemble the shape of the right-handed head-mount 272 depicted in FIG. 9A, with male, right-handed threads.

In yet another embodiment, certain of the shaft-mounts described above can include a stem to secure within a bore of the shaft 30.

In yet another embodiment, certain of the right-handed or left-handed head-mounts described above can include a bore to secure onto a stem of the respective right-handed or left-handed hosel 24, 25 of an associated club head.

It will be appreciated that the above-disclosed embodiments and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A golf club connector, for forming a releasable connection of an associated golf club shaft and one of an associated right-handed golf club head and an associated left-handed golf club head, comprising:

a shaft-mount adapted to secure an end portion of the associated golf club shaft, the shaft-mount including a first threaded coupling member having left-handed threads and right-handed threads; and a head-mount adapted to secure the one associated golf club head, the head-mount including a second threaded coupling member sized to threadingly mate with the first threaded coupling member to form a releasable connection of the head-mount and shaft-mount, wherein the first threaded coupling member includes a shaft with an outer surface, the left-handed threads and the right-handed threads intersecting or overlapping on the outer surface of the shaft.

2. The connector of claim 1, wherein the shaft-mount includes a bore sized to mate with and secure an end portion of the associated golf club shaft.

3. The connector of claim 1, wherein the head-mount includes a stem sized to mate with and secure the one associated golf club head.

4. The connector of claim 1, wherein the second threaded coupling member includes a stem with an inner surface defining a bore sized to receive the shaft of the first threaded coupling member, the inner surface formed with one of mating left-handed threads and mating right-handed threads for threadingly connecting the first threaded coupling member and the second threaded coupling member.

5. The connector of claim 4, wherein the inner surface of the second threaded coupling member is formed with the mating left-handed threads to define a right-handed head-mount for securement to the associated right-handed golf club head.

6. The connector of claim 4, wherein the inner surface of the second threaded coupling member is formed with the mating right-handed threads to define a left-handed head-mount for securement to the associated left-handed golf club head.

7. The connector of claim 1, wherein the second threaded coupling member includes a stem with an inner surface defining a bore sized to receive the shaft of the first threaded coupling member, the inner surface formed with mating intersecting or overlapping left-handed threads and right-handed threads for threadingly connecting the first threaded coupling member and the second threaded coupling member.

8. The connector of claim 1, wherein the head-mount is separate and distinct from each of the shaft-mount and the associated golf club head.

9. A golf club connector, for forming a releasable connection of an associated golf club shaft and one of an associated right-handed golf club head containing a hosel and an associated left-handed golf club head containing a hosel, comprising:

a shaft-mount adapted to secure an end portion of the associated golf shaft, the shaft-mount including a first threaded coupling member having left-handed threads and right-handed threads wherein the first threaded coupling member includes a shaft with an outer surface, the left-handed threads and the right-handed threads intersecting or overlapping on the outer surface of the shaft; and one of a right-handed head-mount separate and distinct from the hosel of the associated right-handed golf club head adapted to secure the hosel of the associated right-handed golf club head and a left-handed head-mount separate and distinct from the hosel of the associated left-handed golf club head adapted to secure the hosel of the associated left-handed golf club head, wherein the right-handed head-mount includes a second threaded coupling member having mating left-handed threads for threaded engagement with the first threaded coupling member to form a releasable connection of the right-handed head-mount and shaft-mount, and wherein the left-handed head-mount includes a second threaded coupling member having mating right-handed threads for threaded engagement with the first threaded coupling member to form a releasable connection of the left-handed head-mount and shaft-mount.

10. The connector of claim 9, wherein the second threaded coupling member of each of the right-handed head-mount and the left-handed head-mount includes a stem with an inner surface defining a bore sized to threadingly receive the shaft of the first threaded coupling member.

11. A golf club connector, for forming a releasable connection of an associated golf club shaft and one of an associated right-handed golf club head and an associated left-handed golf club head, comprising:

a shaft-mount adapted to secure an end portion of the associated golf club shaft, the shaft-mount including a first threaded coupling member having left-handed threads and right-handed threads; and a second threaded coupling member located on the one associated golf club head sized to threadingly mate with the first threaded coupling member to form a releasable connection of the golf club head and shaft-mount, wherein the first threaded coupling member includes a shaft with an outer surface, the left-handed threads and the right-handed threads intersecting or overlapping on the outer surface of the shaft.

12. The connector of claim 11, wherein the second threaded coupling member includes one of mating left-handed threads, mating right-handed threads, and mating intersecting or overlapping left-handed threads and right-handed threads.

13. The connector of claim 11, wherein the shaft-mount includes a bore sized to mate with and secure an end portion of the associated golf club shaft.

14. The connector of claim 11, wherein the second threaded coupling member is formed on a head-mount separate and distinct from the one associated golf club head, the head-mount includes a stem sized to mate with and secure the one associated golf club head.

15. The connector of claim 14, wherein the head-mount includes an inner surface defining a bore sized to receive the shaft of the first threaded coupling member, the inner surface formed with one of mating left-handed threads and mating right-handed threads for threadingly connecting the first threaded coupling member and the second threaded coupling member.

16. The connector of claim 14, wherein the head-mount includes an inner surface defining a bore sized to receive the shaft of the first threaded coupling member, the inner surface formed with mating intersecting or overlapping left-handed threads and right-handed threads for threadingly connecting the first threaded coupling member and the second threaded coupling member.

* * * * *